US006346371B1

(12) United States Patent
Craig et al.

(10) Patent No.: US 6,346,371 B1
(45) Date of Patent: Feb. 12, 2002

(54) PHOTOGRAPHIC ELEMENT CONTAINING A DIR COUPLER

(75) Inventors: Andrew S. Craig, Sevenoaks (GB); Richard P. Szajewski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/857,829

(22) PCT Filed: Dec. 10, 1999

(86) PCT No.: PCT/GB99/04327

§ 371 Date: Jun. 7, 2001

§ 102(e) Date: Jun. 7, 2001

(87) PCT Pub. No.: WO00/38012

PCT Pub. Date: Jun. 29, 2000

(30) Foreign Application Priority Data

Dec. 19, 1998 (GB) ..... 9827966

(51) Int. Cl.[7] ..... G03C 1/08; G03C 7/26; G03C 7/32

(52) U.S. Cl. ..... 430/544; 430/505; 430/957

(58) Field of Search ..... 430/505, 544, 430/955, 957, 567

(56) References Cited

U.S. PATENT DOCUMENTS

| | | | | |
|---|---|---|---|---|
| 4,286,054 A | | 8/1981 | Englemann et al. | |
| 4,315,070 A | | 2/1982 | Ranz et al. | |
| 4,348,474 A | | 9/1982 | Scheerer et al. | |
| 4,387,159 A | | 6/1983 | Engelmann et al. | |
| 4,963,465 A | * | 10/1990 | Matejec et al. | 430/505 |
| 4,980,267 A | | 12/1990 | Taber | |
| 5,270,157 A | * | 12/1993 | Bell et al. | 430/505 |
| 5,356,764 A | | 10/1994 | Szajewski et al. | |

FOREIGN PATENT DOCUMENTS

| | | |
|---|---|---|
| EP | 0 148 441 A2 | 12/1984 |
| EP | 0 520 496 A1 | 12/1992 |
| EP | 0 867 763 A1 | 9/1998 |

OTHER PUBLICATIONS

Derwent JP Abstract 4278942, Konica Corp., Oct. 1992.

* cited by examiner

*Primary Examiner*—Geraldine Letscher
(74) *Attorney, Agent, or Firm*—Sarah Meeks Roberts

(57) ABSTRACT

The invention provides a photographic element comprising at least one emulsion layer comprising at least 50 mol % silver chloride, which layer comprises at least one DIR coupler in association with at least one image dye-forming coupler, characterised in that the relative reactivity ratio $k_{rel}$ of at least one DIR coupler and an associated image coupler is less than or equal to 1.0, wherein $$k_{rel}=k_1/k_2;$$

$k_1$=the second order rate constant for the reaction of DIR coupler with oxidised developer and $k_2$=the second order rate constant for the reaction of image coupler with oxidised developer.

The DIR couplers when associated with image couplers such that the above condition is satisfied efficiently reduce development of silver halide emulsions containing at least 50 mol % silver chloride, there being a reduction in contrast providing a linear sensitometric curve over a good latitude with negligible speed penalty.

14 Claims, 3 Drawing Sheets

PHOTOGRAPHIC ELEMENT CONTAINING A DIR COUPLER

FIELD OF THE INVENTION

The invention relates to photographic elements, such as colour negative films, and in particular to those which contain a development inhibitor-releasing (DIR) coupler in association with an image dye-forming coupler, hereinafter referred to as an image coupler, and more particularly to those wherein the DIR coupler has low reactivity compared to the image coupler.

BACKGROUND OF THE INVENTION

Many silver halide photographic elements, in particular colour negative films, contain development inhibitor-releasing couplers. DIR couplers release inhibitors that can restrain silver development in the layer in which release occurs, as well as in other layers of a multilayer photographic material. DIR couplers can help control photographic gamma (contrast), enhance sharpness (acutance), reduce granularity, improve exposure latitude without speed loss and they can provide colour correction via interlayer interimage effects. A specific class of DIR couplers is DIAR couplers (development inhibitor anchiomeric-releasing) in which the release of the inhibitor is controlled by a timing mechanism.

Generally the DIR is incorporated in the photographic material at a much lower concentration than the image coupler, generally 5–10%. EP-A-0 867 763A describes DIRs in an element containing silver chloride or silver bromoiodide. JP-4278942 exemplifies silver iodide and silver bromoiodide-containing elements including DIRs, providing materials with good sharpness and superior shelf stability. U.S. Pat. No. 5,356,764 discloses a tabular grain silver halide emulsion layer including an image coupler and a DIR coupler wherein at least 50 mol % of the total projected grain area is accounted for by specific tabular grains containing at least 50 mol % silver chloride, providing elements with acceptable image sharpness and reduced gamma (contrast). However there can be some loss in speed and reduced latitude associated with non-linear sensitometric curves and undesirable 'toe scooping'.

In order for the DIR to be able to compete effectively with the image coupler for oxidised developer it has been the practice for it to be more reactive (typically 5–10×) than its associated image coupler, particularly in bromoiodide films, such as described in, for example, U.S. Pat. Nos. 4,286,054, 4,315,070, 4,387,159, 4,348,474 and 4,980,267.

While DIR compounds provide advantageous image properties with silver bromoiodide emulsions, proper development without side-effects is much more difficult to achieve for silver bromide or chloride emulsions because of their superior developability. Silver chloride emulsions can lead to faster and easier processing, including faster and easier development, bleaching and fixing, combined with lower environmental impact.

PROBLEM TO BE SOLVED BY THE INVENTION

There has been a need to provide a means of effectively reducing contrast in elements containing silver halide emulsions comprising at least 50 mol % silver chloride, whereby a linear sensitometric curve over a good latitude with little or no 'toe scooping' or speed loss is obtained.

SUMMARY OF THE INVENTION

It has now been found that the DIR couplers used in elements according to this invention which have a low reactivity relative to its associated image coupler can reduce the contrast of silver halide emulsions comprising at least 50 mol % silver chloride more effectively than DIR couplers of high reactivity, with significant advantages being observed in the sensitometric curve.

According to the present invention therefore there is provided a photographic element comprising at least one emulsion layer comprising at least 50 mol % silver chloride, which layer comprises at least one DIR coupler in association with at least one image dye-forming coupler, characterised in that the relative reactivity ratio $k_{rel}$ of at least one DIR coupler and an associated image coupler is less than or equal to 1.0, wherein $$k_{rel}=k_1/k_2;$$

$k_1$=the second order rate constant for the reaction of DIR coupler with oxidised developer and $k_2$=the second order rate constant for the reaction of image coupler with oxidised developer.

In another aspect of the invention there is provided a multicolour photographic element comprising a support bearing a cyan image-dye-forming unit comprising at least one red-sensitive silver halide emulsion layer and a cyan dye-forming coupler; a magenta image-dye-forming unit comprising at least one green-sensitive silver halide emulsion layer and a magenta dye-forming coupler; a yellow image-dye-forming unit comprising at least one blue-sensitive silver halide layer and a yellow dye-forming coupler, wherein at least one of the layers comprises an emulsion comprising at least 50 mol % silver chloride, which layer comprises at least one DIR coupler in association with at least one image dye-forming coupler, characterised in that in any one layer the relative reactivity ratio $k_{rel}$ of at least one DIR coupler and an associated image coupler is less than or equal to 1.0, where $k_{rel}$ is as hereinbefore defined.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

The DIR couplers, when associated with image couplers in elements of the invention, efficiently reduce development of silver halide emulsions containing at least 50 mol % silver chloride, i.e. there is a reduction in contrast, providing a linear sensitometric curve over a good latitude with negligible speed penalty.

DETAILED DESCRIPTION OF THE INVENTION

Figure 1:
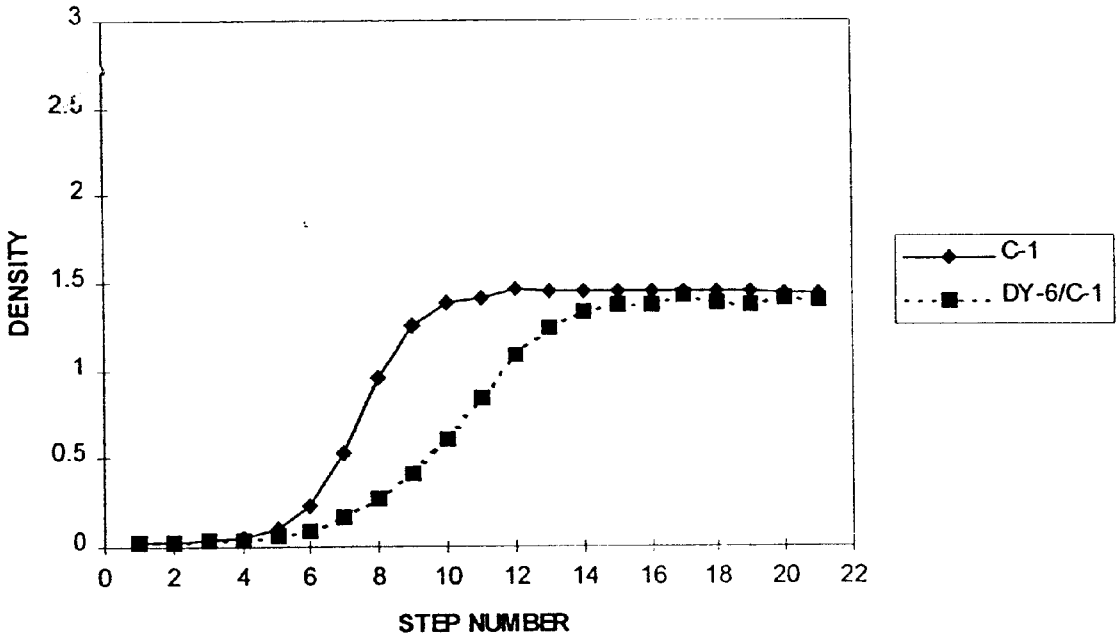
FIGS. 1 and 2 show plots of density vs. log exposure or step number (DlogE curve) for the image coupler C-1 alone and for the control combinations of DIR couplers DY-6 and DC-29 respectively in association with image coupler C-1 at a molar ratio of 12:100.

As used herein and throughout the specification the term 'silver chloride' refers to a silver halide emulsion in which at least 50 mol %, preferably at least 70 mol %, more preferably at least 90 mol %, of the silver halide, is silver chloride. In a particular embodiment the emulsion has T-grain morphology, the T-grains formed of silver chloride forming a face-centered cubic crystal lattice structure with either {100} or {111} major faces, as discussed hereinafter. Preferably at least 30% of the silver chloride grains have T-grain morphology. Reference herein and throughout the specification to a 'DIR' coupler specifically includes reference to the anchiomeric 'DIAR' coupler.

In accordance with the invention, it is possible for the photographic element to comprise in any one layer comprising at least 50 mol % silver chloride at least one example of an image coupler in association with at least one example of the same or any other structural type of DIR coupler, as long as the $k_{rel}$ of the DIR coupler to each associated image coupler is less than or equal to 1.0, preferably less than 0.7, more preferably less than 0.5, especially less than 0.3. However it is generally preferred that the image coupler and the associated DIR coupler are selected from those couplers which form the same colour dye upon reaction with oxidised colour developing agent, although there is no particular reference for the specific structural type of couplers to be the same.

Suitably the DIR coupler may be one of the DC, DY, DM or DU couplers, as listed hereinafter, which have been designed specifically to be of low reactivity in order to achieve $k_{rel} \leqq 1.0$ in combinations with 'conventional' image couplers. However, the invention is not restricted to the use of these DIR couplers as it is possible by using known higher activity image couplers and known higher activity DIR couplers to obtain further examples with $k_{rel} \leqq 1.0$.

The inhibitor coupling-off moiety of the DIR coupler may be a heterocyclic compound, such as a triazole, benzotriazole or purine, as discussed hereinafter, or a thiol based inhibitor, such as a mercaptotetrazole, and specifically for a DIAR coupler it will comprise a timing moiety of one or more chemical switches which produces a delayed release of inhibitor.

Suitable examples of inhibitor moieties that can be used with advantage in the present invention are a purine or preferably the S-assist benzotriazole inhibitor coupling-off group (SI),

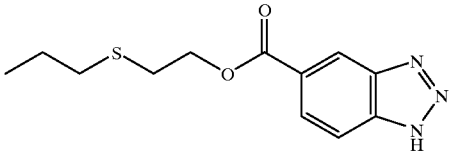

The coupler may be joined to the inhibitor moiety via a switch group such as a 5-membered carbamate switch, a quinone-methide switch or a double switch. For all of these switches, variations in coupler moiety can produce changes in reactivity.

In the carbamate switch below

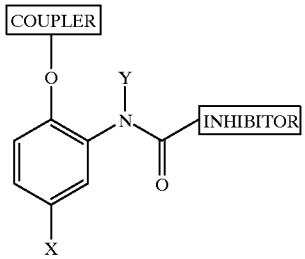

substituent variations in the X and/or Y-positions allow for changes in coupler reactivity. Thus varying X from a $NO_2$ group to one with a lower Hammett-$\sigma_p$ value renders the coupling-off group a poorer leaving group with corresponding reduction in reactivity.

The following is an example of a para-quinone methide switch although the ortho switch could also be used:

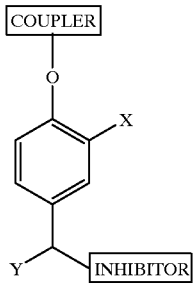

In the following double switch, the inhibitor is linked to an amino acid switch group, which is in turn linked to a conventional quinone methide switch:

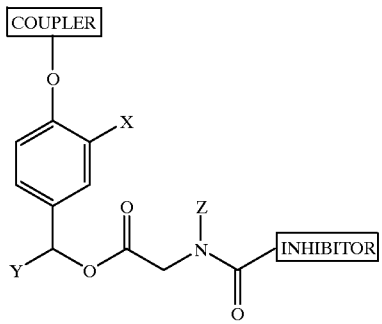

As above, variations in X and Y in each of the above can alter reactivity of the DIR coupler.

The ratio of the amount of DIR coupler to its associated image coupler in any one layer comprising at least 50 mol % silver chloride may be from greater than 0 to about 25%, preferably from about 5 to about 20%, more preferably about 10 to about 15%, 12% having been found to be the ratio for certain specific examples for use in this invention which provide optimum contrast reduction and curve profile.

As detailed hereinafter, a typical cyan image coupler for use in the invention may be selected from a phenol, naphthol or pyrazoloazole, specific examples being selected from the following:

C-1

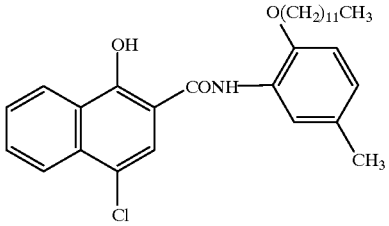

C-2

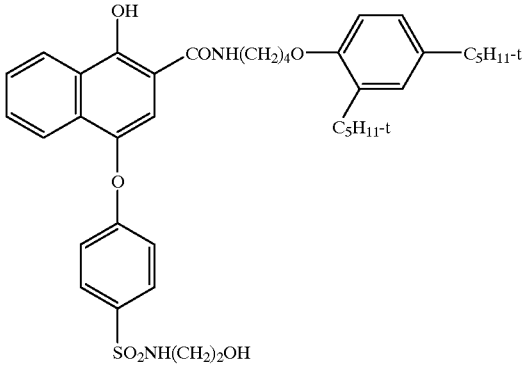

C-3

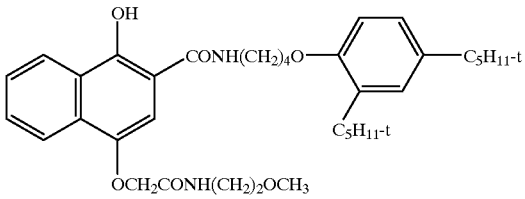

C-4

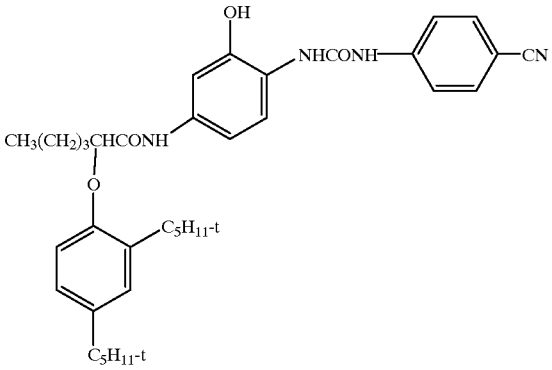

C-5

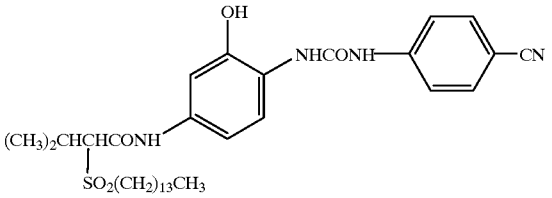

-continued

C-6

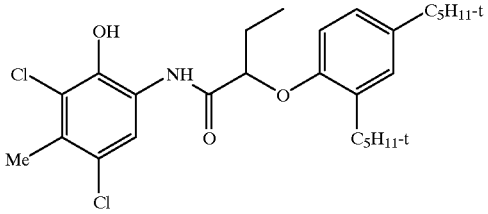

A typical yellow image dye-forming coupler for use in the invention may be an open chain ketomethylene compound, such as one of the following:

Y-1

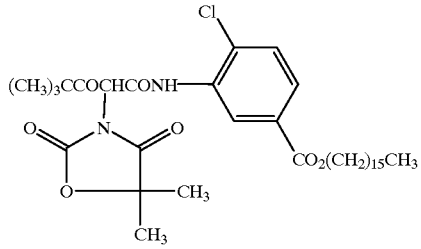

Y-2

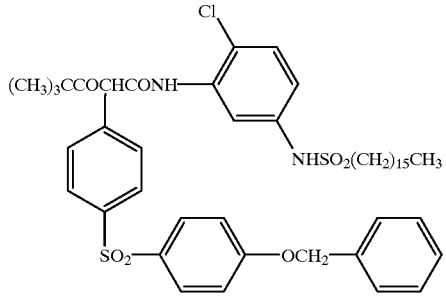

Y-3

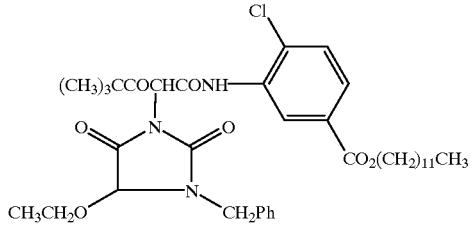

Y-4

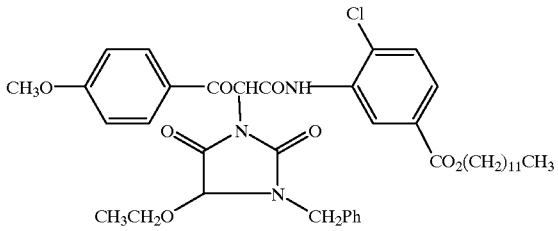

A typical image dye-forming coupler forming a magenta dye upon reaction with oxidized developing agent may be a pyrazolone, pyrazoloazole or pyrazolo-benzimidazole and for use in the invention may be selected from one of the following:

M-1
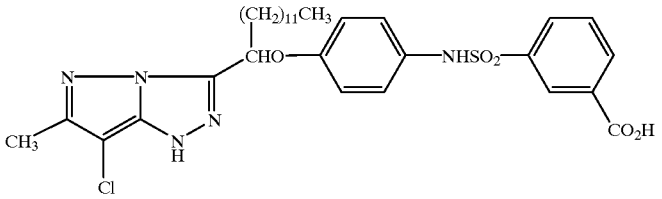
M-2
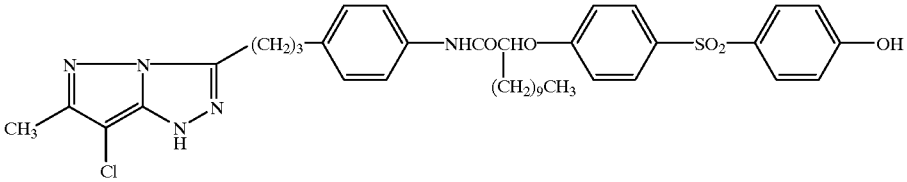
M-3
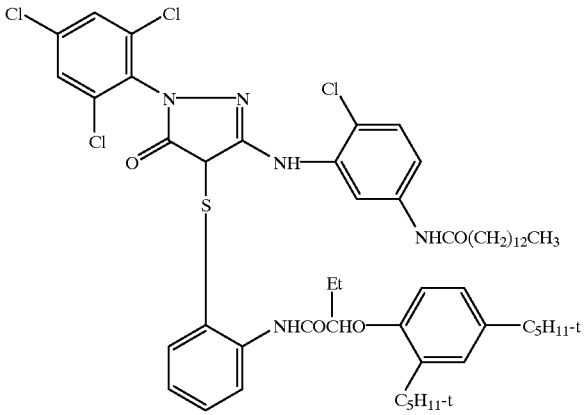
M-4
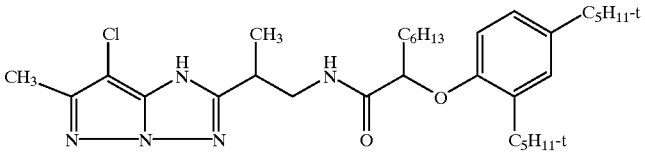
M-5
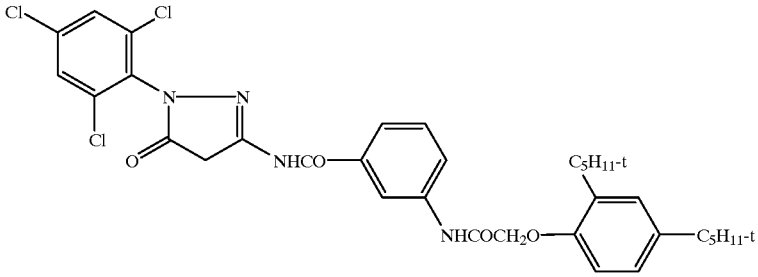

Examples of DIR couplers for use in the invention include the following:
DC-1
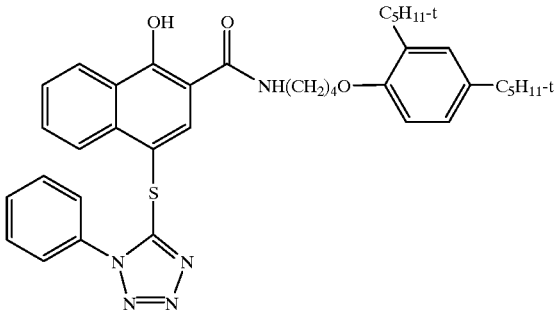
DC-2
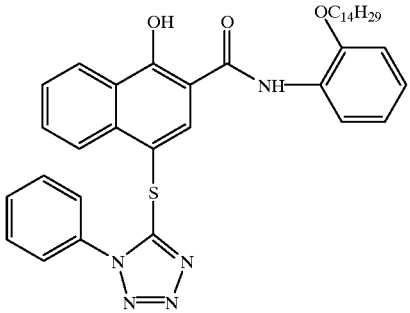
DC-3
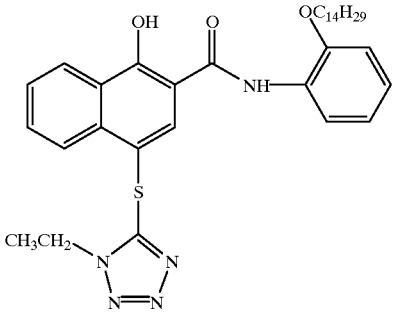
DC-4
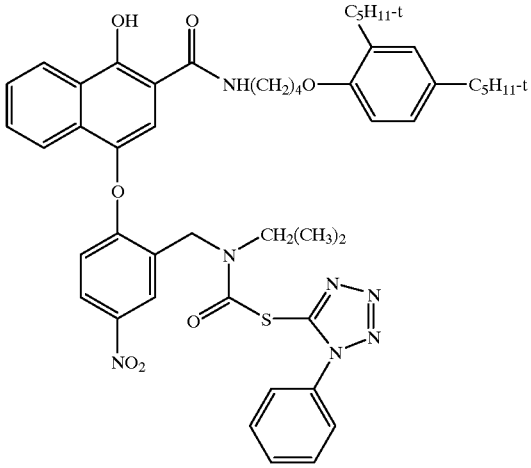

-continued
DC-5
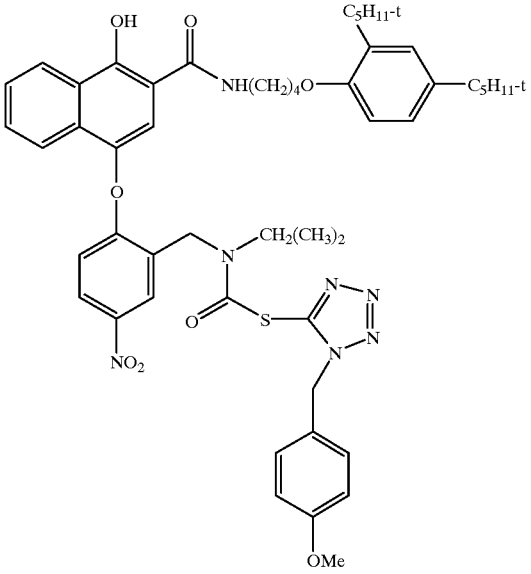
DC-6
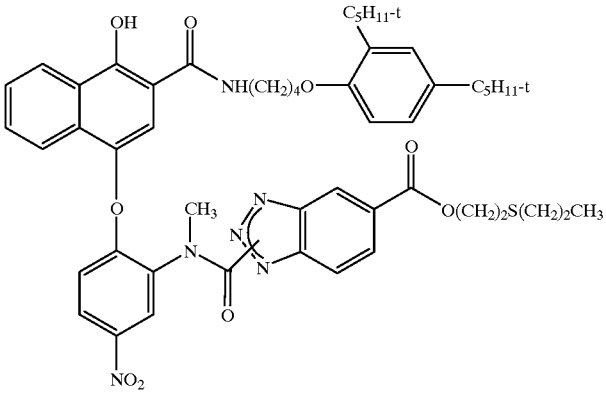
DC-7
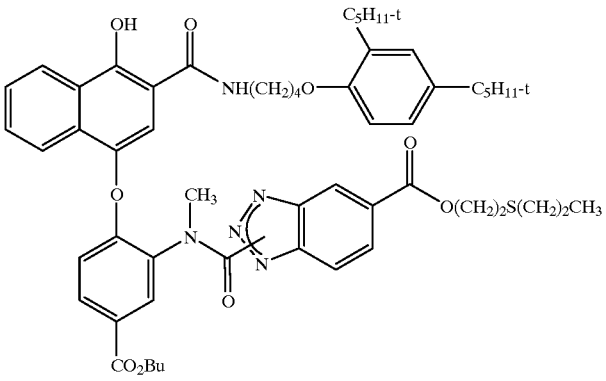

-continued
DC-8
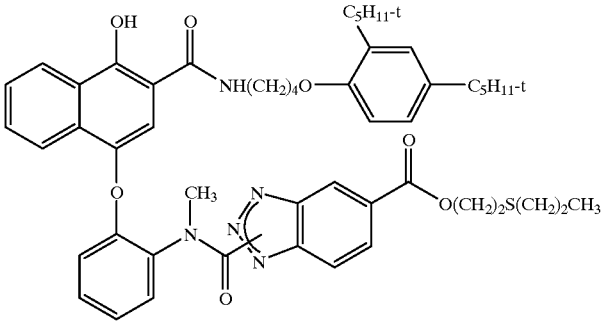
DC-9
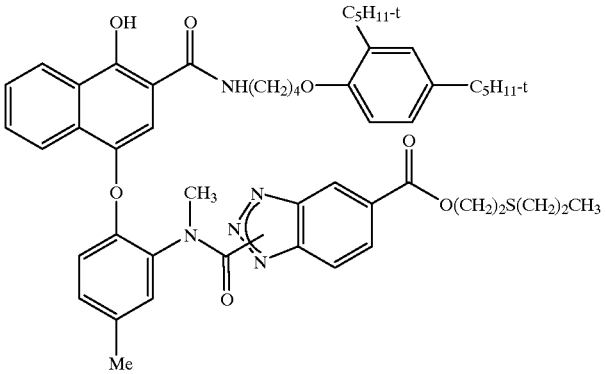
DC-10
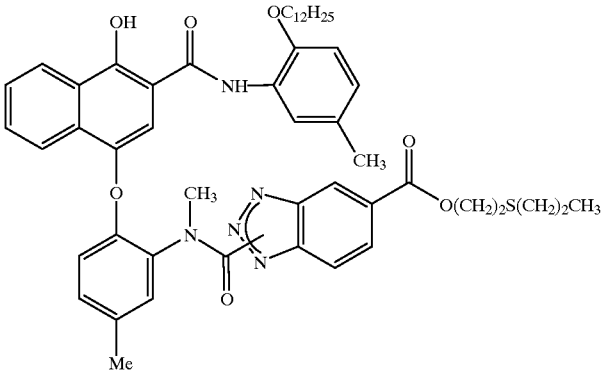
DC-11
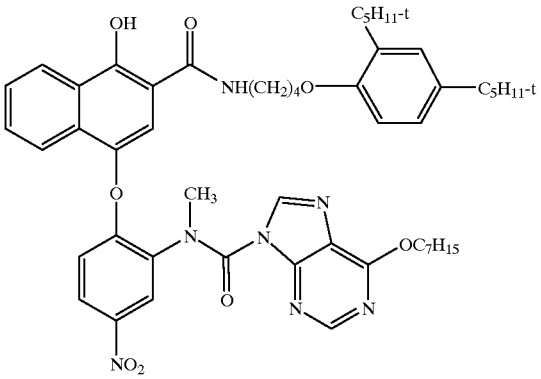

-continued
DC-12
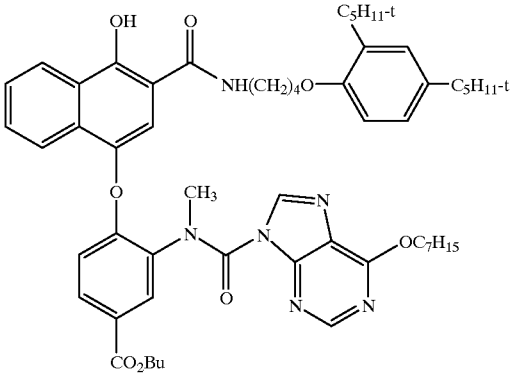
DC-13
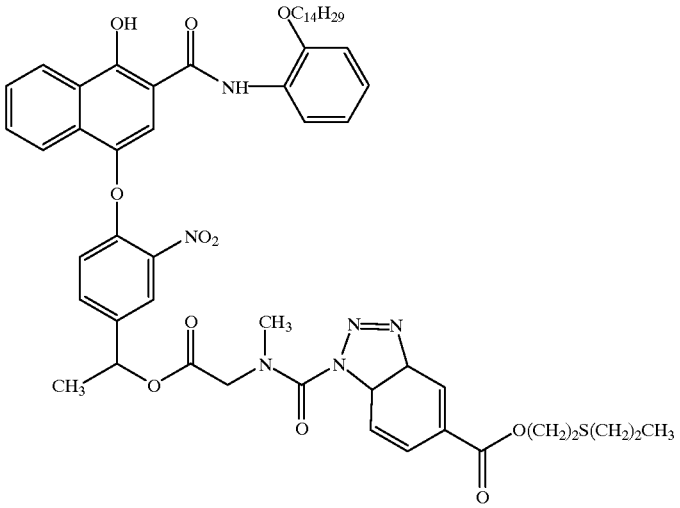
DC-14
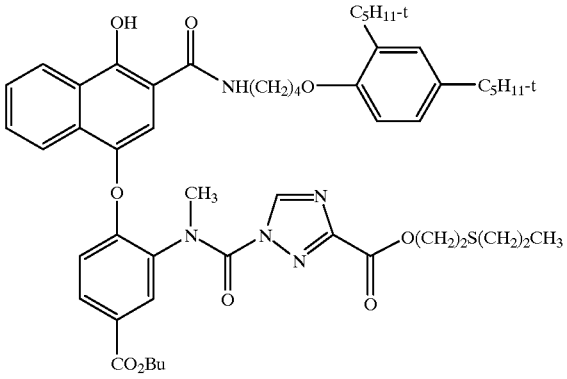

-continued
DC-15
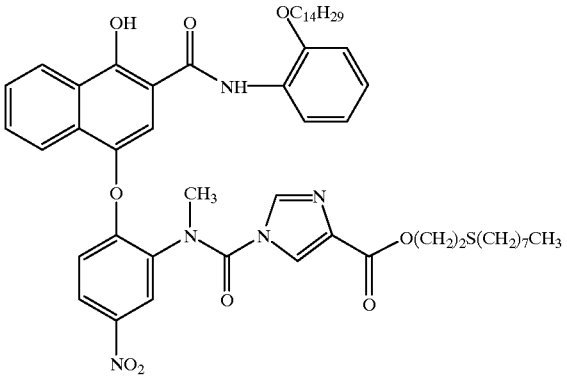
DC-16
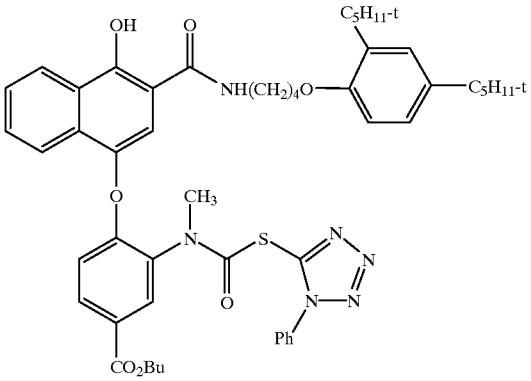
DC-17
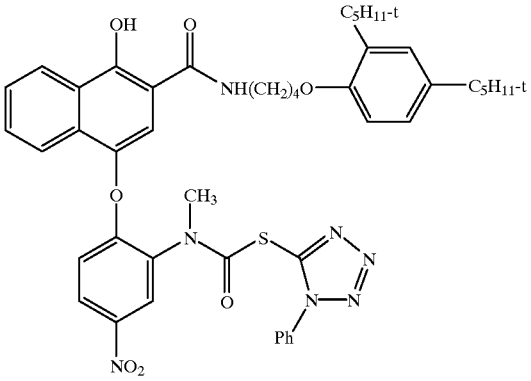
DC-18
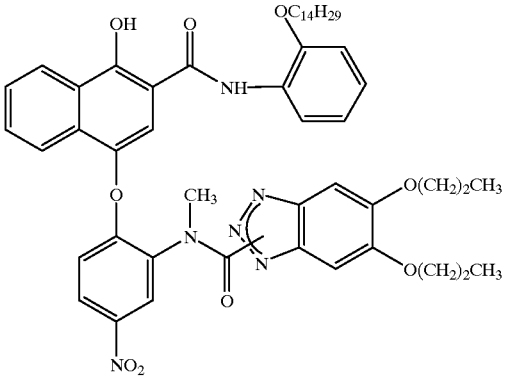

-continued
DC-19
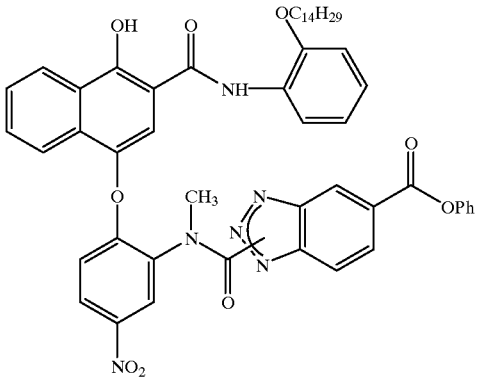
DC-20
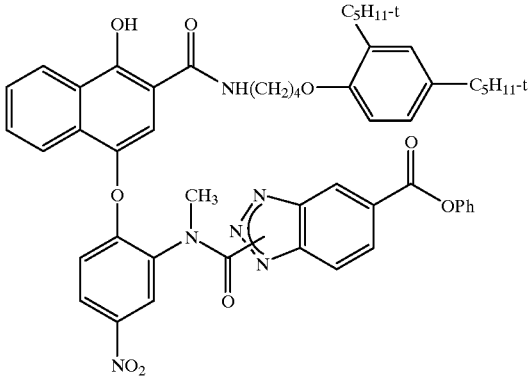
DC-21
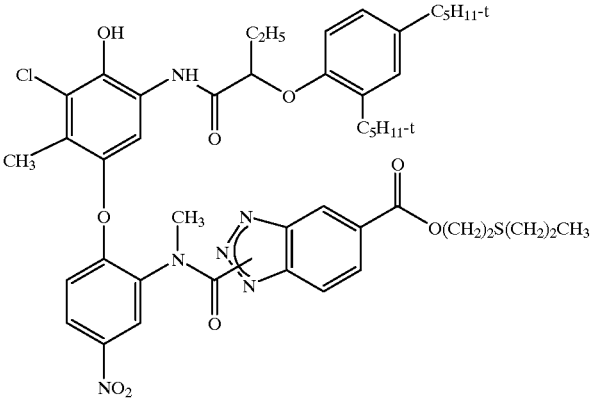
DC-22
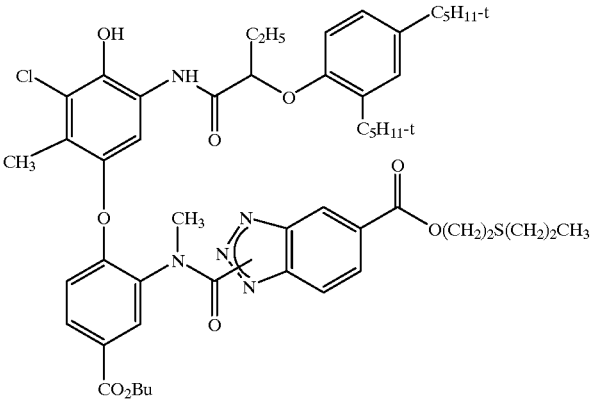

-continued
DC-23
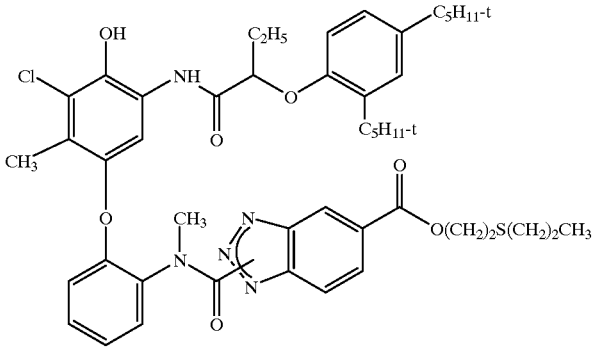
DC-24
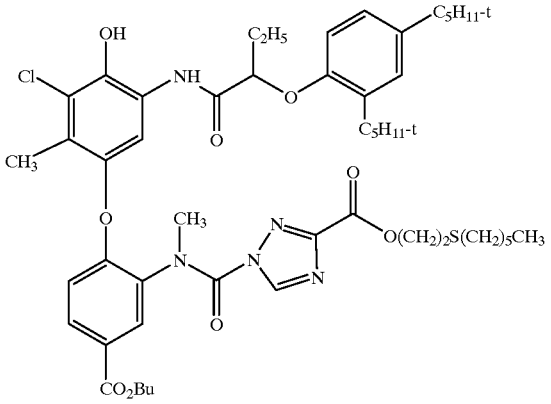
DC-25
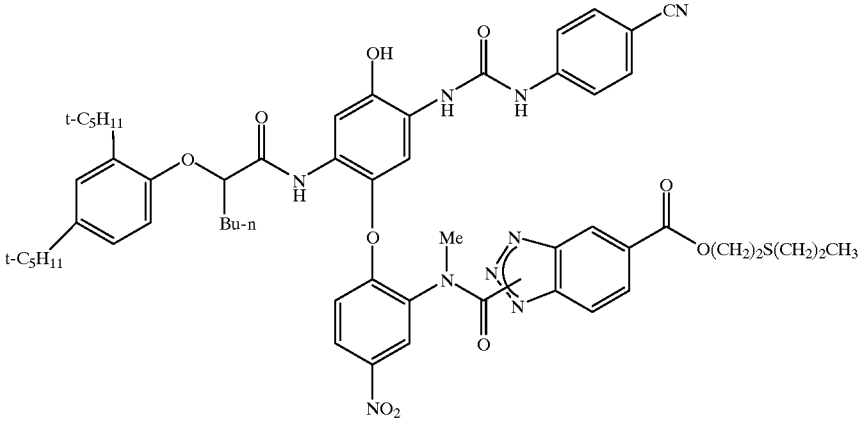
DC-26
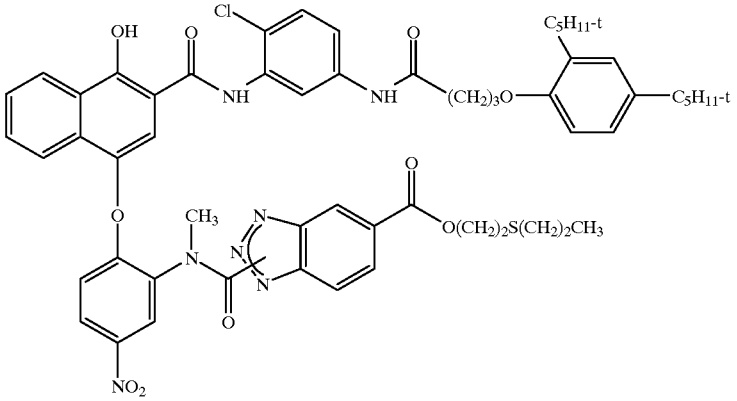

-continued
DC-27
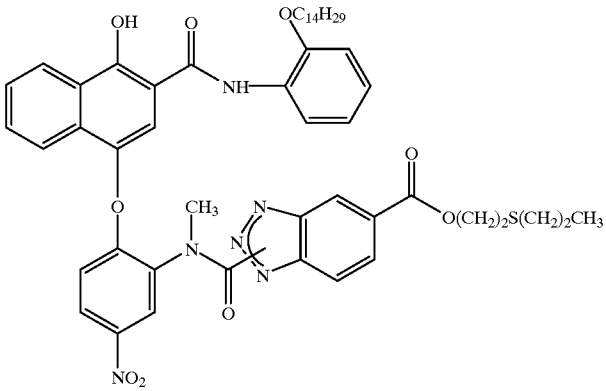
DC-28
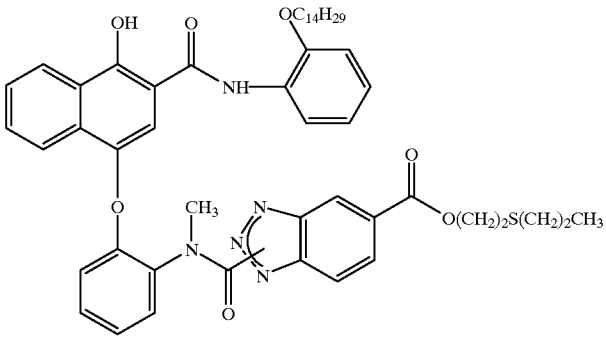
DC-29
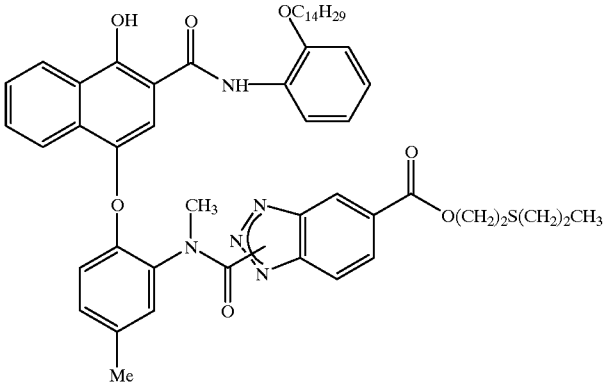
DC-30
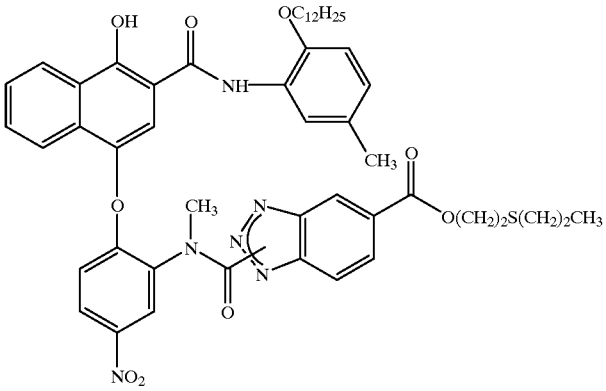

-continued
DC-31
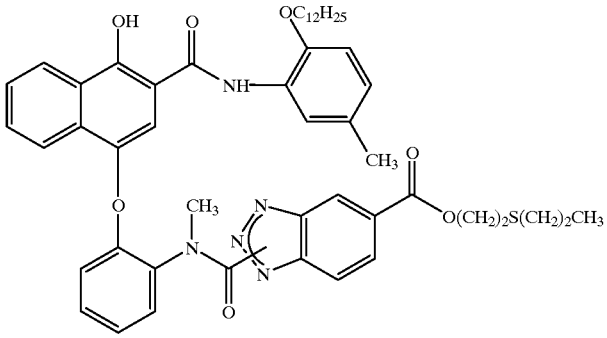
DC-32
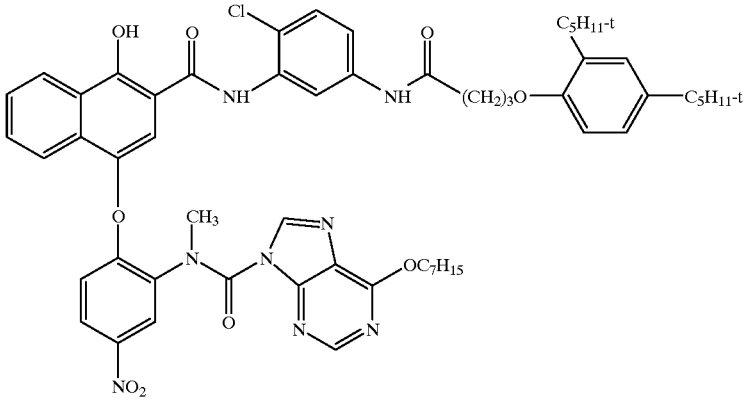
DC-33
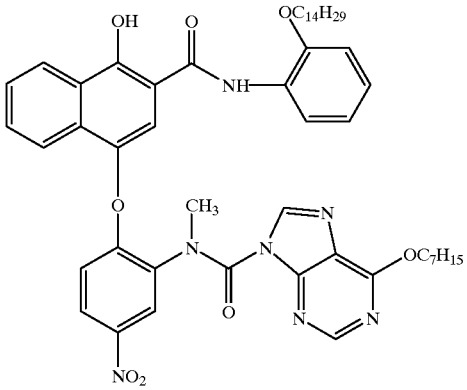
DC-34
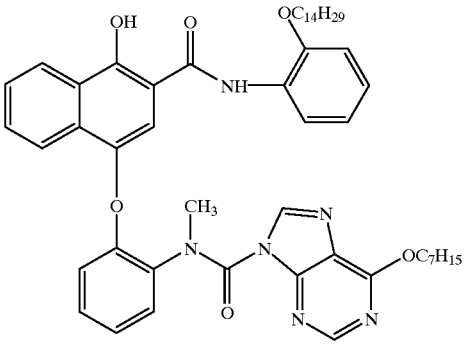

-continued
DY-1
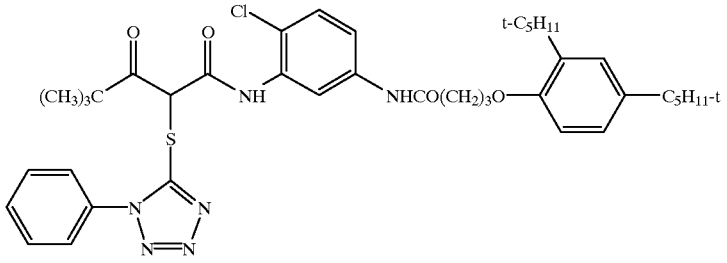
DY-2
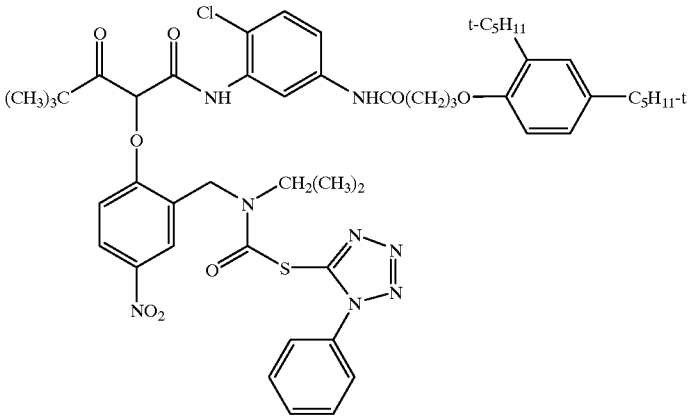
DY-3
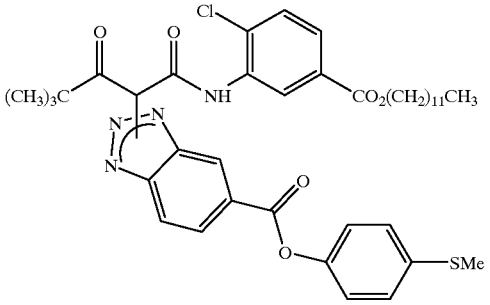
DY-4
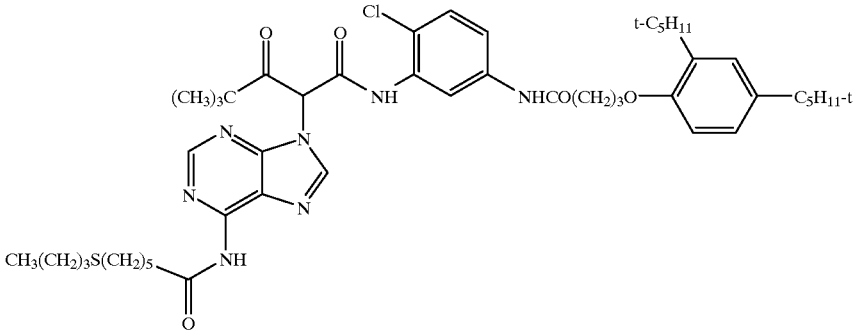

-continued
DY-5
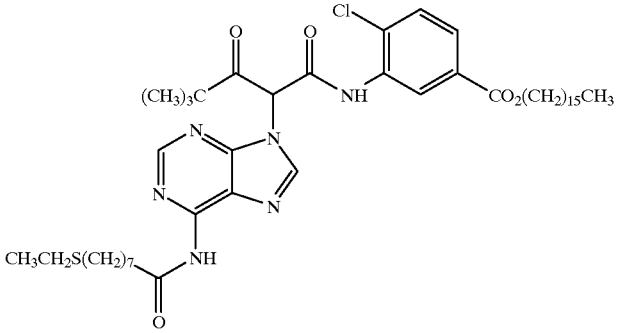
DY-6
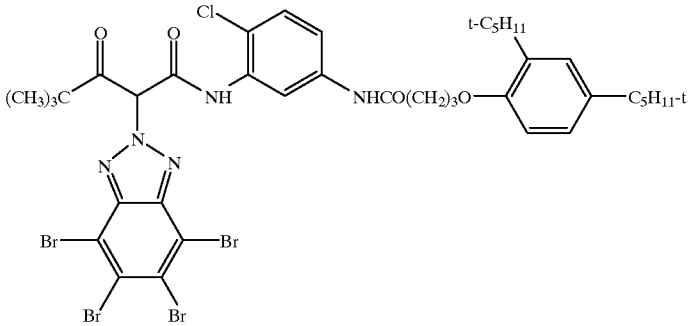
DM-1
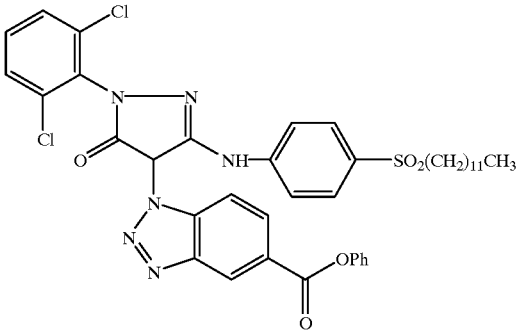
DM-2
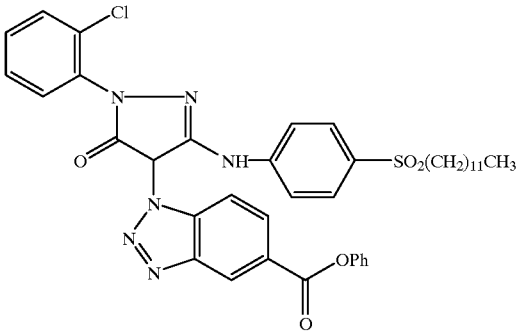

-continued
DM-3
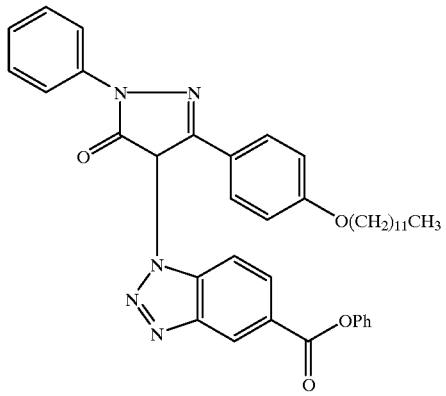
DM-4
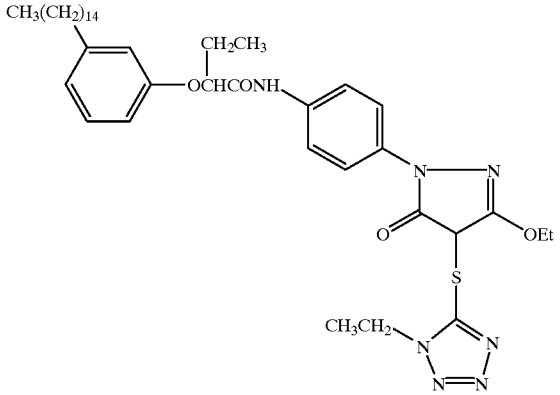
DM-5
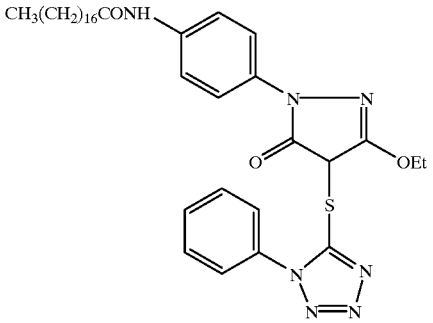

-continued

DM-6

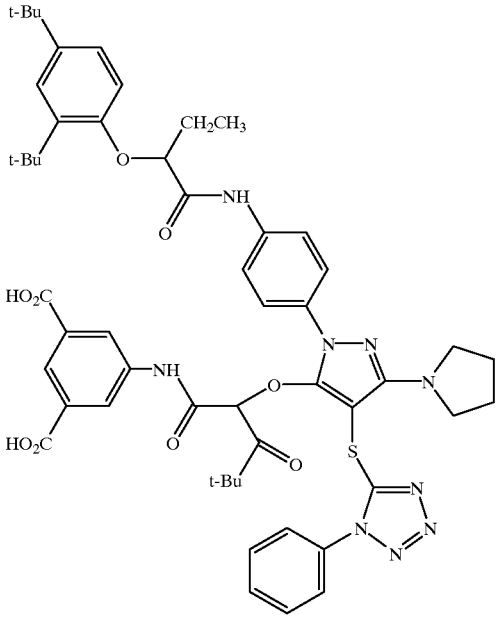

DU-1

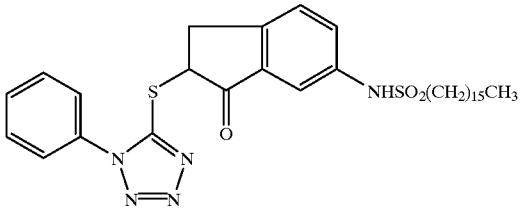

DU-2

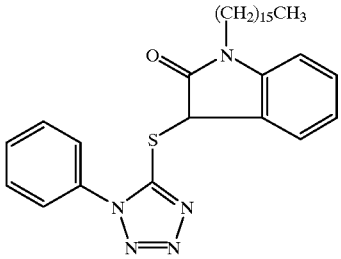

DU-3

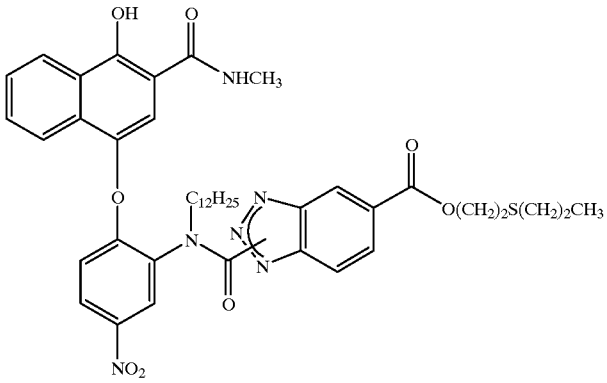

As used herein and throughout the specification the term alkyl refers to an unsaturated or saturated straight or branched chain alkyl group having 1–25 atoms and specifically includes cycloalkyl having 3–8 carbon atoms and aralkyl. The terms aryl and heterocyclic specifically include fused aryl and fused heterocyclic respectively within their scope.

Any substituent may be chosen to further substitute the substituent groups of any particular DIR or image coupler useful in this invention that does not adversely affect its photographic performance and provided that the conditions of $k_{rel}$ required by the present invention are satisfied. When the term "group" is applied to the identification of a substituent containing a substitutable hydrogen, it is intended to encompass not only the substituent's unsubstituted form, but also its form further substituted with any group or groups as herein mentioned. As used herein any tautomeric forms are considered to be within the scope of the invention.

Suitably, the group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy) hexanamido, alpha-(4-hydroxy-3-t-butylphenoxytetradecanamido, 2-oxo-pyrrolidin-1-yl, 2-oxo-5-tetradecyl-pyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido. N,N-di-octyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methyl-sulfonamido, benzenesulfonamido, p-toluylsulfonamido, p-dodecylbenzene sulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethyl-sulfamoyl; N-[3-(dodecyloxy)propyl]sulfamoyl, N-[4-(2,4-di-t-pentylphenoxybutyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfmyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imido, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups and groups which adsorb to silver halide. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

The materials for use in the invention can be used in any of the ways and in any of the combinations known in the art. Typically, they are incorporated in a silver halide emulsion and the emulsion coated as a layer on a support to form part of a photographic element. Alternatively, unless provided otherwise, they can be incorporated at a location proximate to the silver halide emulsion layer where, during development, they will be in reactive association with development products such as oxidized color developing agent. Thus, as used herein, the term "associated" signifies that the compound is incorporated at a location where, during processing, it is capable of reacting with silver halide development products.

The emulsion layer of the photographic element of the invention can comprise any one or more of the light sensitive layers of the photographic element. The photographic elements made in accordance with the present invention can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler wherein at least one of the silver halide emulsion layers comprises at least 50 mol % of silver chloride.

In an element especially useful for films designed for scanning, the different light sensitive layers need only be associated with dye-forming couplers which form dyes of sufficiently distinct hue so as to enable a unique mapping of developed dye to scanner signal during a scanning operation. In another element, a luminance—chrominance sensitization scheme may be employed. In a further element, a panchromatic emulsion sensitization may be employed in combination with a dye forming coupler or coupler set and a colour filter array.

The image couplers and DIR couplers of this invention are employed in colour photographic elements. Such elements typically contain at least one silver halide emulsion sensitive to blue light, at least one silver halide emulsion sensitive to green light and at least one silver halide emulsion sensitive to red light, at least one of the silver halide emulsions comprising at least 50 mol % silver chloride. The DIR couplers used in this invention are particularly advantageous when included in a silver chloride emulsion sensitive to blue light.

The element can be employed with a transparent support or with a reflective support, (e.g. a paper support) as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230 provides suitable embodiments. Alternatively the photographic element can be used in conjunction with a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 $\mu$m. While the order of the colour sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film pre-loaded in them and the entire camera is returned to a processor with the exposed film remaining inside the camera. Such cameras may have glass or plastic lenses through which the photographic element is exposed.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as otherwise provided, the silver halide emulsion containing elements employed in this invention can be either negative-working or positive-working as indicated by the type of processing instructions (i.e. colour negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Colour materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with colour reflective prints, are described in *Research Disclosure*, Item 37038, February 1995. U.S. Pat. No. 5,558,980 discloses loaded latex compositions, such as poly- and t-butyl-acrylamides which can be incorporated into any photographic coating in any layer to provide extra dye stability.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EP-A-0 246 616; EP-A-0 250 201; EP-A-0 271 323; EP-A-0 295 632; EP-A-0 307 927; EP-A-0 333 185; EP-A-0 378 898; EP-A-0 389 817; EP-A-0 487 111; EP-A-0 488 248; EP-A-0 539 034; EP-A-0 545 300; EP-A-0 556 700; EP-A-0 556 777; EP-A-0 556 858; EP-A-0 569 979; EP-A-0 608 133; EP-A-0 636 936; EP-A-0 651 286; EP-A-0 690 344; German OLS 4,026,903; German OLS 3,624,777 and German OLS 3,823,049. Typically such couplers are phenols, naphthols, or pyrazoloazoles.

Typical cyan couplers are represented by the following formulae:

CYAN-1

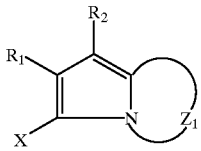

CYAN-2

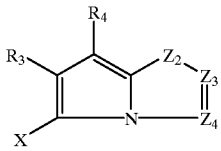

CYAN-3

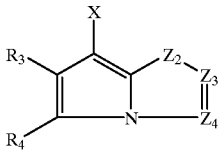

CYAN-4

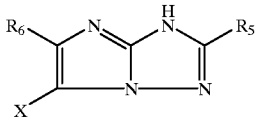

wherein $R_1$, $R_5$ and $R_8$ each represent a hydrogen or a substituent; $R_2$ represents a substituent; $R_3$, $R_4$ and $R_7$ each represent an electron attractive group having a Hammett's substituent constant $\sigma_p$ of 0.2 or more and the sum of the $\sigma_p$ values of $R_3$ and $R_4$ is 0.65 or more; $R_6$ represents an electron attractive group having a Hammett's substituent constant $\sigma_p$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C(R7)═and —N═; and $Z_3$ and $Z_4$ each represent —C(R8)═and —N═.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EP-A-0 257 854; EP-A-0 284 240; EP-A-0 341 204; EP-A-0 347 235; EP-A-0 365252; EP-A-0 422 595; EP-A-0 428 899; EP-A-0 428 902; EP-A-0 459 331; EP-A-0 467 327; EP-A-0 476 949; EP-A-0 487 081; EP-A-0 489 333; EP-A-0 512 304; EP-A-0 515 128; EP-A-0 534 703; EP-A-0 554 778; EP-A-0 558 145; EP-A-0 571 959; EP-A-0 583 832; EP-A-0 583 834; EP-A-0 584 793; EP-A-0 602 748; EP-A-0 602 749; EP-A-0 605 918; EP-A-0 622 672; EP-A-0 622 673; EP-A-0 629 912; EP-A-0 646 841, EP-A-0 656 561; EP-A-0 660 177; EP-A-0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153, 4,665,015; 4,822,730; 4,945,034; 5,017,465 and 5,023,170. Examples of 1H-pyrazolo [1,5-b]-1,2,4-triazoles can be found in European Patent applications 0 176804; 0 177 765; U.S. Pat. Nos. 4,659,652; 5,066,575 and 5,250,400.

Typical pyrazoloazole and pyrazolone couplers are represented by the following formulae:

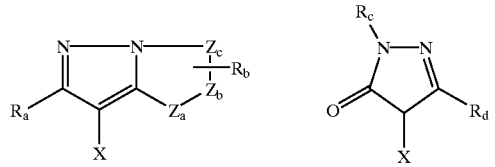

wherein $R_a$ and $R_b$ are independently hydrogen or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, ═N—, ═C— or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ is a methine group connected to the group $R_b$.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EP-A-0 327 976; EP-A-0 296 793; EP-A-0 365 282; EP-A-0 379 309; EP-A-0 415 375; EP-A-0 437 818; EP-A-0 447 969; EP-A-0 542 463; EP-A-0 568 037; EP-A-0 568 196; EP-A-0 568 777; EP-A-0 570 006; EP-A-0 573 761; EP-A-0 608 956; EP-A-0 608 957; and EP-A-0 628 865. Such couplers are typically open chain ketomethylene compounds.

Also preferred are yellow couplers such as described in, for example, European Patent Application Nos. 0 482552; 0 510535; 0 524 540; 0 543 367 and U.S. Pat. No. 5,238,803. For improved colour reproduction, couplers which give yellow dyes that cut off sharply on the long wavelength side are particularly preferred (for example, see U.S. Pat. No. 5,360,713).

Typical preferred yellow couplers are represented by the following formulae:

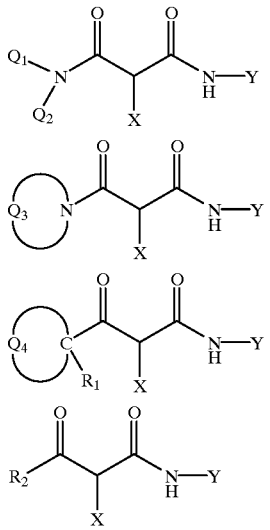

wherein $R_1$, $R_2$, $Q_1$ and $Q_2$ are each a substituent; X is hydrogen or a coupling-off group; Y is an aryl group or a heterocyclic group; $Q_3$ is an organic residue required to form a nitrogen-containing heterocyclic group together with the >N—; and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Couplers that form colourless products upon reaction with oxidized colour developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colourless products on reaction with an oxidized colour developing agent.

Couplers that form black dyes upon reaction with oxidized colour developing agent are described in such representative patents as U.S. Pat. Nos. 1,939,231; 2,181,944; 2,333,106 and 4,126,461; German OLS No. 2,644,194 and German OLS No. 2,650,764. Typically, such couplers are resorcinols or m-aminophenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP Patent Publication No. 0 213 490; Japanese Published Application 58-172,647; U.S. Pat. Nos. 2,983,608, 4,070,191 and 4,273,861; German Applications DE 2,706,117 and DE 2,643,965; UK Patent No. 1,530,272 and Japanese Application 58-113935. The masking couplers may be shifted or blocked, if desired.

The materials for use in the invention may be used in association with materials that accelerate or otherwise modify the processing steps, e.g. of bleachilng or fixing, to improve the quality of the image. Bleach accelerator releasing couplers such as those described in EP Patent Publication Nos. 0 193 389, 0 301 477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anti colour-mixing agents such as derivatives of hydroquinones, aminophenols, amines, gallic acid; catechol; ascorbic acid; hydrazides; sulfonamidophenols and non colour-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP Patent Publication No. 096,570). Also, the compositions may be blocked or coated in protected form as described, for example, in Japanese Application 61/258,249 or U.S. Pat. No. 5,019,492.

The photographic elements may further contain other image-modifying compounds such as other DIRs. Additional DIRs or elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publication Nos.:0 272 573; 0 335 319, 0 336 411; 0 346 899; 0 362 870; 0 365 252; 0 365 346; 0 373 382; 0 376 212; 0 377 463; 0 378 236; 0 384 670; 0 396 486; 0401 612 and 0 401 613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercapto-tetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. For example, the inhibitor moiety or group may be selected from the following formulae:

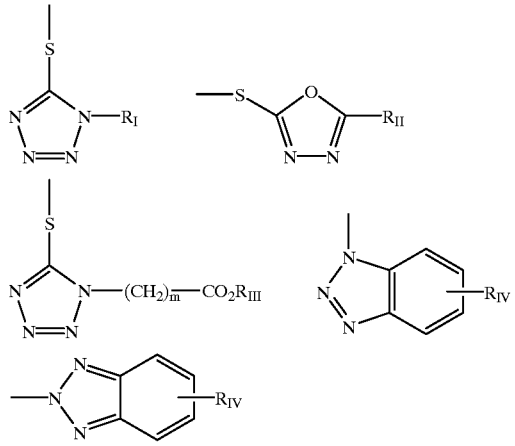

wherein $R_1$ is selected from the group consisting of straight and branched alkyls of from 1 to about 8 carbon atoms, benzyl, phenyl and alkoxy groups and such groups containing none, one or more than one such substituent; $R_{11}$ is selected from $R_1$ and $SR_1$; $R_{111}$ is a straight or branched alkyl group of from 1 to about 5 carbon atoms and m is from 1 to 3; and $R_{Iv}$ is selected from the group consisting of hydrogen, halogens and alkoxy, phenyl and carbonamido groups, —$COOR_V$ and $NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701 and Japanese Applications 57-188035; 58-98728; 58-209736 and 58-20973 8); groups utilizing ester hydrolysis (German Patent Application (OLS) No. 2,626,315); groups that function as a coupler or reducing agent after the coupler reaction (U.S. Pat. Nos. 4,438,193 and 4,618,571) and groups that combine the features described above. It is typical that the timing group is of one of the formulae:

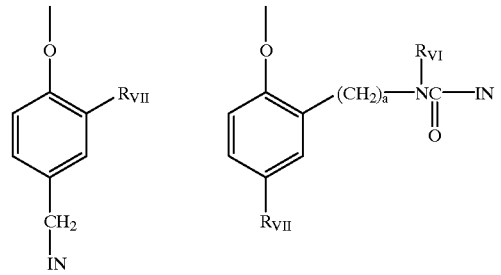

wherein IN is the inhibitor moiety, Z is selected from the group consisting of nitro, cyano, alkylsulfonyl; sulfamoyl (—$SO_2NR_2$) and sulfonamido (—$NRSO_2R$) groups; n is 0 or 1; and $R_{vI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP Patent Publication Nos. 0 464 612, 0 523 451, U.S. Pat. No. 4,146,396, and Japanese Kokais 60-249148 and 60-249149.

Suitable developer inhibitor-releasing couplers that may be included in photographic light sensitive emulsion layer include, but are not limited to, the following:

D1

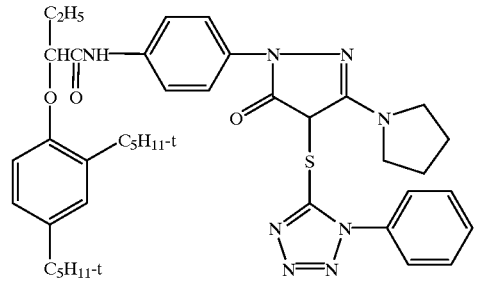

D2

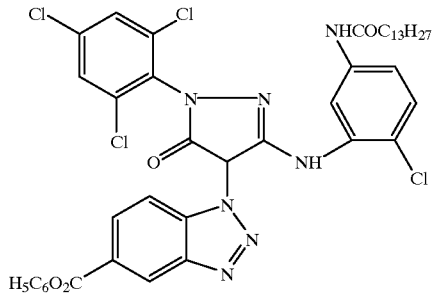

D3
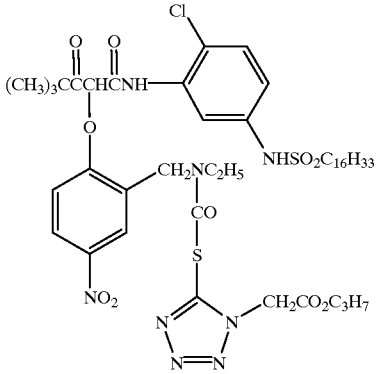
D4
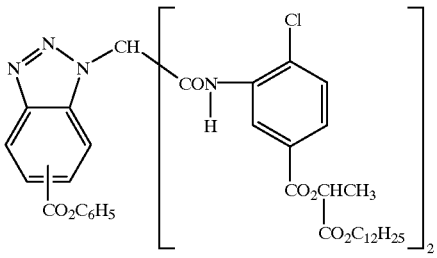
D5
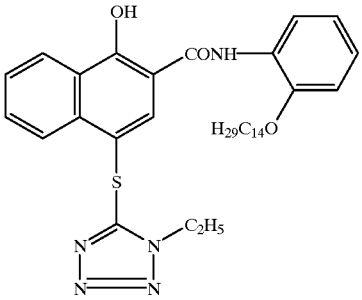
D6
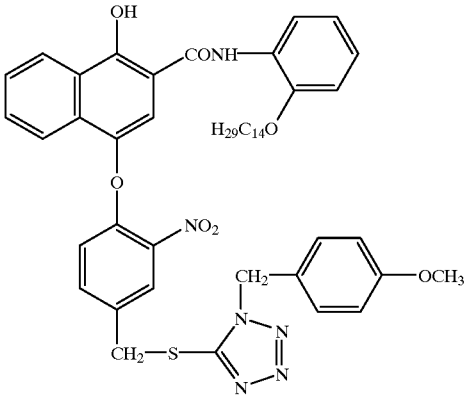
D7
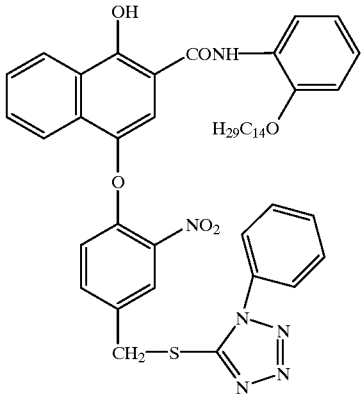
D8
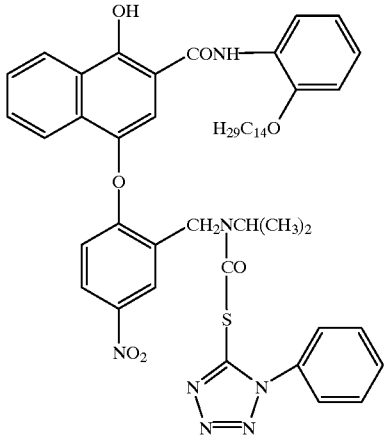
D9
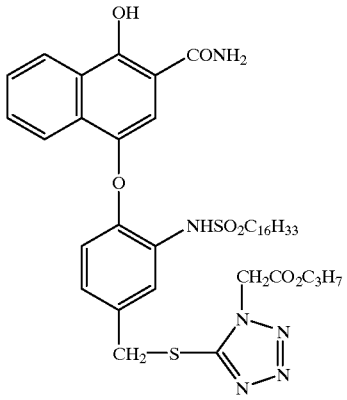

-continued

D10

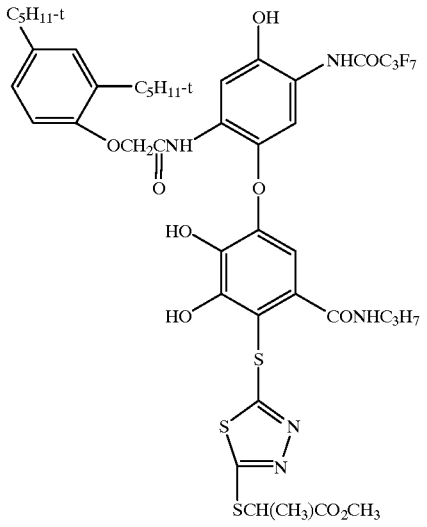

D11

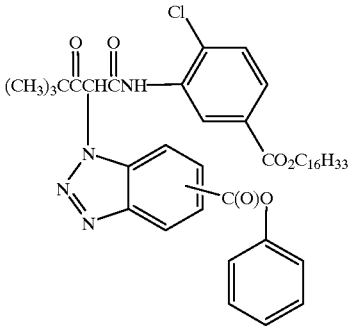

D12

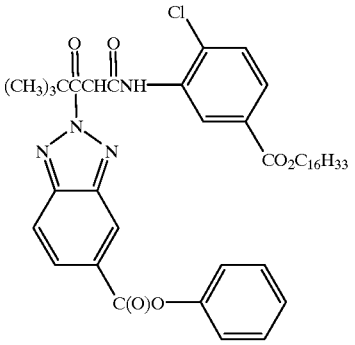

It is also contemplated that the concepts of the present invention may be employed to obtain reflection colour prints as described in *Research Disclosure*, November 1979, Item 18716, available from Kenneth Mason Publications, LItd, Dudley Annex, 12a North Street, Emsworth, Hampshire P0101 7DQ, England, incorporated herein by reference. Materials for use in the invention may be coated on a pH adjusted support as described in U.S. Pat. No. 4,917,994; on a support with reduced oxygen permeability (EP Patent Publication No. 0 553 339); with epoxy solvents (EP Patent Publication No 0 164 961); with nickel complex stabilizers (e.g. U.S. Pat. Nos. 4,346,165, 4,540,653 and 4,906,559); with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,63 1; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586 and 83-09,959.

The dispersion of the couplers for use in the invention can be prepared by dissolving the materials in one or more high-boiling permanent organic solvents, with or without a low-boiling or partially water-soluble auxiliary organic solvent. A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, such as a colloid mill, homogenizer, microfluidizer, high-speed mixer, ultrasonic dispersing apparatus, blade mixer, device in which a liquid stream is pumped at high pressure through an orifice or interaction chamber, Gaulin mill or blender to form small particles of the organic phase suspended in the aqueous phase. More than one type of device may be used to prepare the dispersions. The auxiliary organic solvent may then removed by evaporation, noodle washing, or membrane dialysis. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

Examples of suitable auxiliary solvents which can be used in the present invention include: ethyl acetate, isopropyl acetate, butyl acetate, ethyl propionate, 2-ethoxyethyl acetate, 2-(2-butoxyethoxy)ethyl acetate, dimethylformamide, 2-methyltetrahydrofuran, triethyl phosphate, cyclohexanone, butoxyethyl acetate, methylisobutyl ketone, methyl acetate, 4-methyl-2-pentanol, diethyl carbitol, 1,1,2-trichloroethane and 1,2-dichloropropane.

The aqueous phase of the coupler dispersions for use in the invention preferably comprises gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecylbenzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

In an alternative embodiment, the couplers for use in the invention may be dispersed without any high-boiling organic solvent. This could take the form of microprecipitated dispersions of the photographic couplers, prepared by solvent and/or pH shift techniques as described in references: U.K. Patent No. 1,193,349; Research Disclosure 16468, December 1977 pp.75–80; and in U.S. Pat. Nos. 4,970,139; 5,089,380; 5,008,179 and 5,104,776. These no-solvent coupler dispersions could be combined with a separate dispersion containing one or more high boiling solvents in an aqueous coating solution and the dispersion could also include a stabilizer.

Aqueous dispersions of high-boiling solvents can be prepared similarly to the coupler dispersion(s), e.g. by adding the solvent to an aqueous medium and subjecting such mixture to high shear or turbulent mixing as described above. The aqueous medium is preferably a gelatin solution, and surfactants and auxiliary solvents may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill homogenizer, microfluidizer, high speed mixer or ultrasonic dispersing apparatus to form small particles of the organic solvent suspended in the aqueous phase. If an auxiliary solvent is employed, it is then subsequently removed by evaporation, noodle washing, or membrane dialysis. These methods are described in detail in the aforementioned references on dispersion making. The solvent dispersion may be a "blank" dispersion which does not contain any additional photographically useful compounds, or the solvent may be part of a photographically useful compound dispersion.

An aqueous coating solution in accordance with the present invention may then be prepared by combining the coupler dispersions with the separate dispersion of the high-boiling organic solvent. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50C) for a short period of time (e.g. 5 min to 4 h) prior to coating.

Although at least 50 mol % of the silver halide is silver chloride, as hereinbefore defined, the balance generally consists of bromide, iodide or a mixture thereof. The silver chloride grains used in the invention may have a variety of morphologies, such as cubic, but tabular grain silver chloride emulsions are preferred. The grain size of the silver chloride may have any distribution known to be useful in photographic compositions, and may be either polydispersed or monodispersed.

Tabular grains are those with two parallel major faces each clearly larger than any remaining grain face and tabular grain emulsions are those in which the tabular grains account for at least 30%, more typically at least 50%, preferably at least 70% and optimally at least 90% of total grain projected area. The tabular grains can account for substantially all (at least 97%) of total grain projected area The tabular grains have a thickness of less than 0.3 micrometers ($\mu$m) (0.5 $\mu$m for blue sensitive emulsion) and an average tabularity (T) of greater than 25 (preferably greater than 100), where the term "tabularity" is employed in its art recognized usage as $$T=ECD/t^2$$

wherein

ECD is the average equivalent circular diameter of the tabular grains in $\mu$m, and t is the average thickness in $\mu$m of the tabular grains.

The tabular grain emulsions can be high aspect ratio tabular grain emulsions, i.e. ECD/t>8, intermediate aspect ratio tabular grain emulsions, i.e. ECD/t=5 to 8; or low aspect ratio tabular grain emulsions, i.e. ECD/t=2 to 5. The tabular grains can be of any thickness compatible with achieving an aim average aspect ratio and/or average tabularity of the tabular grain emulsion. Emulsion tabularity increases markedly with reductions in tabular grain thickness. Thus it is generally preferred that aim tabular grain projected areas be satisfied by thin (t<0.2 $\mu$m) tabular grains. To achieve the lowest levels of granularity it is preferred that aim tabular grain projected areas be satisfied with ultrathin (t<0.06 $\mu$m) tabular grains. Tabular grain thicknesses typically range down to about 0.02 $\mu$m. However, still lower tabular grain thicknesses are contemplated. Ultrathin tabular grain high chloride emulsions are contemplated for maximum tabular grain performance enhancements, as disclosed by Maskasky in U.S. Pat. No. 5,217,858.

The average useful ECD of photographic emulsions can range up to about 10 $\mu$m, although in practice emulsion ECDs seldom exceed about 4 $\mu$m. Since both photographic speed and granularity increase with increasing ECDs, it is generally preferred to employ the smallest tabular grain ECDs compatible with achieving aim speed requirements.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095, 4,853,322; 4,914,014; 4,962,015; 4,985,350; 5,061,069 and 5,061,616.

Tabular grains formed of silver chloride that form a face-centered cubic (rock salt type) crystal lattice structure can have either {100} or {111} major faces. Emulsions containing {111} major face tabular grains, including those with controlled grain dispersities, chloride distributions, twin plane spacing, edge structures and grain dislocations as well as adsorbed {111} grain face stabilizers, are illustrated in those references cited in *Research Disclosure I*, Section LB.(3) (page 503).

Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463, Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508, Hasebe et al U.S. Pat. No. 4,820,624; Maskasky U.S. Pat. No. 5,264,337 and 5,275,930; House et al U.S. Pat. No. 5,320,938 and Chen et al U.S. Pat. No. 5,550,013, Edwards et al U.S. Ser. No. 08/362,283 filed on Dec. 22, 1994; and U.S. Pat. Nos. 5,726,005 and 5,736,310.

The emulsions may be precipitated in any suitable environment such as a ripening environment, a reducing environment or an oxidizing environment. Reducing agents present in the dispersing medium during precipitation can be employed to increase the sensitivity of the grains. Conversely, oxidizing agents may be present during precipitation, used as a pre-treatment of the dispersing medium or added to the emulsion after grain formation before or during sensitization, in order to improve the sensitivity/fog position of the silver halide emulsion or minimize residual ripening agent.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling, for example the temperature, pAg and pH at suitable values during formation of the silver halide by precipitation. To avoid fog, precipitation is customarily conducted on the halide side of the equivalence point (the point at which silver and halide ion activities are equal).

In the course of grain precipitation one or more dopants (grain occlusions other than silver and halide) can be introduced to modify grain properties. For example, any of the various conventional dopants disclosed in *Research Disclosure*, Item 38957, Section I 'Emulsion grains and their preparation', sub-section G. 'Grain modifying conditions and adjustments', paragraphs (3),(4) and (5), can be present in the emulsions of the invention. In addition it is specifically contemplated to dope the grains with transition metal hexacoordination complexes containing one or more organic ligands, as taught by Olin et al U.S. Pat. No. 5,360,712.

It is specifically contemplated to incorporate in the face-centered cubic crystal lattice of the grains a dopant capable of increasing imaging speed by forming a shallow electron trap as discussed in Research Disclosure Item 36736 published November 1994.

The photographic elements of the present invention, as is typical, provide the silver chloride in the form of an emulsion. Photographic emulsions generally include a vehicle for coating the emulsion as a layer of a photographic element. Useful vehicles include both naturally occurring substances such as proteins, protein derivatives, cellulose derivatives (e.g. cellulose esters), gelatin (e.g. alkali-treated gelatin such as cattle bone or hide gelatin, or acid-treated gelatin such as pigskin gelatin), deionized gelatin, gelatin derivatives (e.g., acetylated gelatin and phthalated gelatin) and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine and methacrylamide copolymners, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of colour image-forming coupler immediately before coating or in advance of coating (for example, 2h).

The addition of one or more foggants as stain reducing agents is also common in silver halide systems. Tetraazaindenes, such as 4-hydroxy-6-methyl-(1,3,3a,7)-tetraazaindene, mercaptotetrazoles, such as 1-phenyl-5-mercaptotetrazole or acetamido-1-phenyl-5-mercaptotetrazole and arylthiosulfonates, such as tolylthiosulfonate or esters thereof, are commonly used as stabilizers.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements of the present invention are preferably imagewise exposed using any of the known techniques, including those described in *Research Disclosure I*, section XVI. This involves exposure to actinic radiation, typically in the visible region of the spectrum, to form a latent image and then processing to form a visible dye image. Processing to from a visible dye image includes the step of contacting the element with a colour developing agent (that is an agent which will form the coloured image dyes with the colour couplers), to reduce developable silver halide and oxidize the colour developing agent. Oxidised colour developing agent in turn reacts with coupler to yield a dye. The element is then treated with an oxidizing agent and a solvent to remove silver and silver halide. Typically such exposure is of a live image through a lens, although exposure can also be exposure to a stored image (such as a computer stored image) by means of light emitting devices (such as light emitting diodes and CRT).

Photographic elements of the invention can be processed in any of a number of well-known photographic processes utilizing any of a number of well-known processing compositions, described, for example, in *Research Disclosure I* or in T. H. James, Editor, *The Theory of the Photographic Process*, 4th Edition, Macmillan, New York, 1977. With negative-working silver halide, the processing step described above provides a negative image. The described elements can be processed in the known Kodak C-41 colour process as described in The British Journal of Photography Annual of 1988, pp 191–198. Where applicable, the element may be processed in accordance with colour print processes such as the RA-4 process of Eastman Kodak Company as described in the British Journal of Photography Annual of 1988, pp 198–199. Such negative working emulsions are typically sold with instructions to process using a colour negative method such as the C-41 or RA-4 process.

In the case of processing a reversal colour element, the colour development step can be preceded by development with a black-and-white i.e. non-cbromogenic developer (that is, a developer which does not form coloured dyes with the coupler compounds) to develop exposed silver halide, but not form dye, followed by uniformly fogging the element (usually chemical fogging or light fogging) to render unexposed silver halide developable. Such reversal emulsions are typically sold with instructions to process using a colour reversal process such as E-6. Alternatively, a direct positive emulsion can be employed to obtain a positive image.

The multicolour photographic elements of the invention may be processed alternatively in a developer solution that will provide reduced processing times of one minute or less (dry to dry), and particularly reduced colour development times of less than about 25 seconds, such that all colour records are fully developed with aim sensitometry.

Preferred colour developing agents are p-phenylenediamines. Especially preferred are:

4-amino N,N-diethylaniline hydrochloride, 4-amino-3-methyl-N,N-diethylani line hydrochloride, 4-amino-3-methyl-N-ethyl-N-(β-(methanesulfonamido) ethylaniline sesquisulfate hydrate, 4-amino-3-methyl-N-ethyl-N-(β-(hydroxyethyl)aniline sulfate, 4-amino-3-(β-(methanesulfonamido)ethyl-N,N-(diethyl) aniline hydrochloride and 4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and *Bissonette Research Disclosure*, Vol. 148, August, 1976, Items 14836, 14846 and 14847. The photographic elements can be particularly adapted to form dye images by such processes as illustrated by Dunn el al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EP-A-0 487 616, Tannahill et al WO 90/13059, Marsden et al WO 90/13061, Grimsey et al WO 91/16666, Fyson WO 91/17479, Marsden et al WO 92/0 1972. Tannahill WO 92/05471, Henson WO 92/07299, Twist WO 93/01524 and WO 93/11460 and Wingender et al German OLS 4,211,460.

The coupler dispersions may be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is colour material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB Patent Nos. 1,268,126, 1,399,481, 1,403,418, 1,560,572 and U.S. Pat. Nos. 3,748,138, 3,822,129 and 4,097,278. In such processes, colour materials are developed to produce a silver image (which may contain only small amounts of silver) and are then treated with a redox amplifying solution (or a combined developer-amplifier) to form a dye image.

The invention has been described in detail with particular reference to certain preferred embodiments thereof, but it will be understood that variations and modifications can be effected within the spirit and scope of the invention.

The following examples illustrate the synthesis and use of DIR couplers in accordance with the invention. In these examples none of the reaction conditions or yields has been optimised.

EXAMPLE 1

Preparation of DC-7

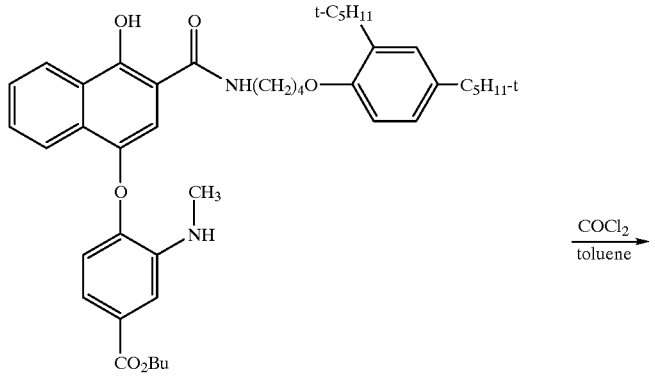

(1)

-continued

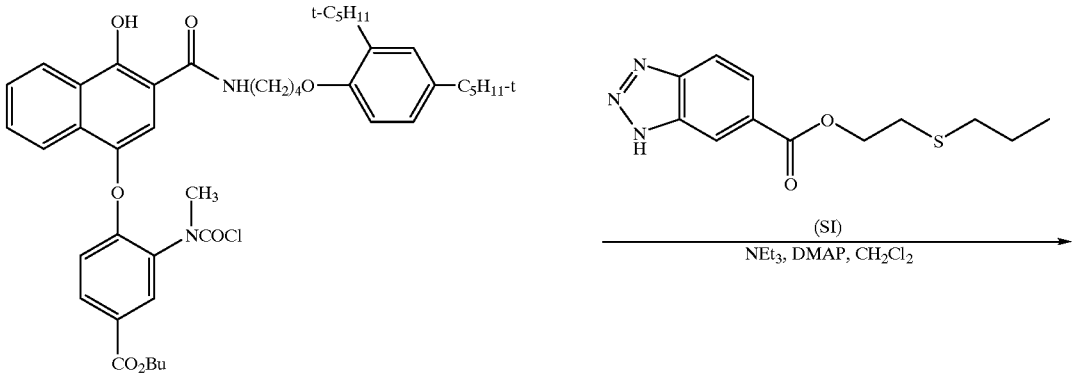

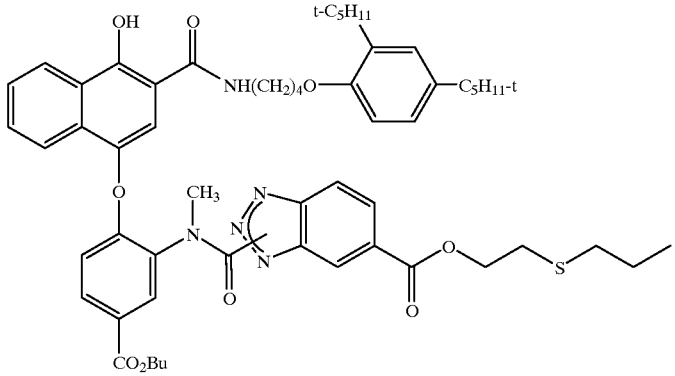

Compound (2)

A solution of phosgene in toluene (41 ml) was added to a solution of (1) (CAS Registry No. 72143-85-2) (18.57 g) in toluene (200 ml) and stirred for 2 h. The reaction mixture was concentrated to give (2) as a dark solid.

Coupler DC-7

Compound (2) was dissolved in dichloromethane (200 ml) and compound (SI) (CAS Registry No. 13467-42-7) (7.0 g) and triethylamine (5.4 g) added and the mixture stirred at room temperature for 10 min. N,N-dimethylaminopyridine (DMAP) (0.5 g) was added and the reaction mixture was stirred overnight. Further quantities of triethylamine (0.3 g) and compound (SI) (0.35 g) were added to the reaction mixture which was again stirred overnight. The reaction mixture was washed with 10% hydrochloric acid then twice with brine, dried over magnesium sulphate and the solvent removed by evaporation to give the crude product as a chestnut coloured solid. The product was purified by column chromatography using petroleum ether:ethyl acetate (elution gradient 10:1 to 6:1) to give a solid product (17.65 g, 67%). Elemental analysis calculated C, 68,06; H, 7.04; N, 7.09; S, 3.24. Found C, 68.13; H, 7.12; N, 6.88; S, 3.44.

Couplers DC-8 and DC-9 were prepared analogously.

EXAMPLE 2

Preparation of DC-6

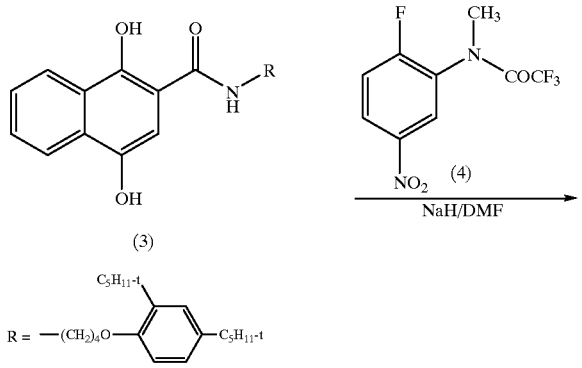

-continued

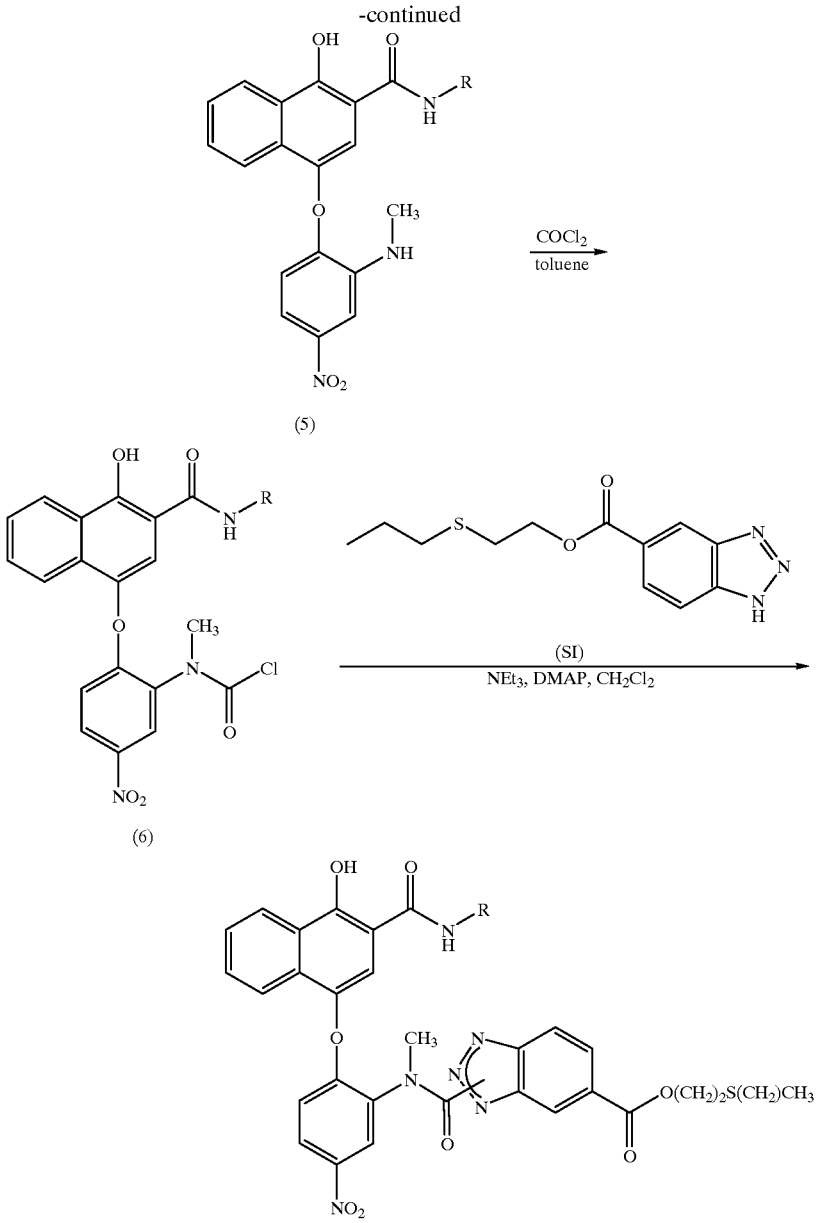

Compound (4)

This compound was prepared from 2-fluoro-5-nitro-N-methylaniline methods knowvn in the art for the formation of amides.

Compound (5)

This compound was prepared by reacting compound (3) (CAS Registry No. 54978-84-6), with compound (4) in the presence of four equivalents of sodium hydride in DMF. Standard work-up conditions provided the title compound in a yield of 60%.

Compound (6)

A 20% solution of phosgene in toluene (10 ml) was added to (5) (6.4 mmol) and the mixture stirred for 20 min. Acetonitrile (50 ml) was added to the stirred mixture and after 10 min the precipitate was collected by filtration and washed with acetonitrile. Yield; 91%.

Coupler DC-6

Triethylamine (0.44 g, 4.35 mmol) was added to a mixture of (6) (2.17 mmol) and the S-assist inhibitor SI (0.58 g, 2.17 mmol) in dichloromethane (40 ml) and the mixture stirred for 5 min. DMAP (0.05 g, 0.43 mmol) was added and the solution stirred at room temperature for 16 h. The mixture was washed with dil. HCl, brine, dried ($MgSO_4$) and evaporated to afford a pale brown viscous oily residue. Compound (2) was purified by flash column chromatography—gradient elution 4:1 to 2:1 petroleum ether:ethylacetate. Yield 75%.

EXAMPLE 3

Preparation of I)C-21

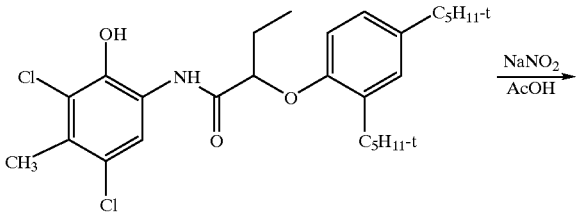
(7)
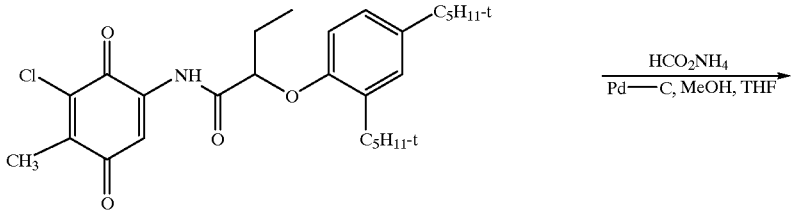
(8)
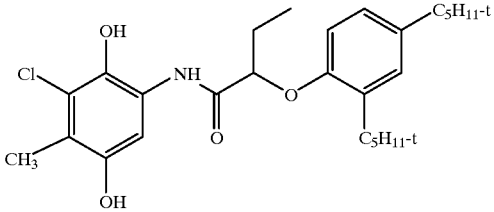
(9)
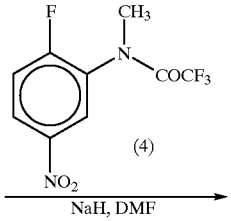
(4)
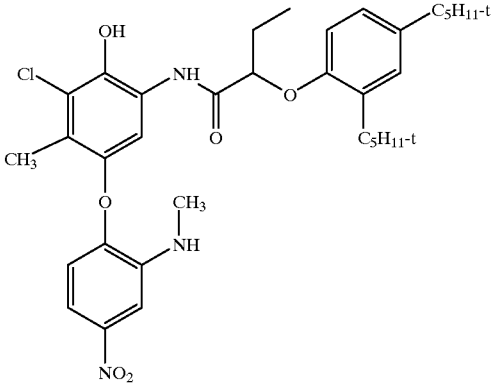
(10)

-continued

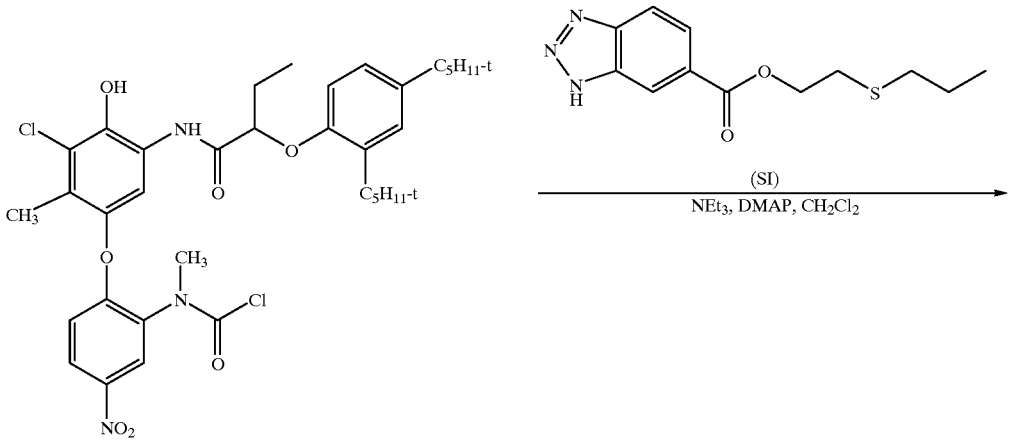

(11)

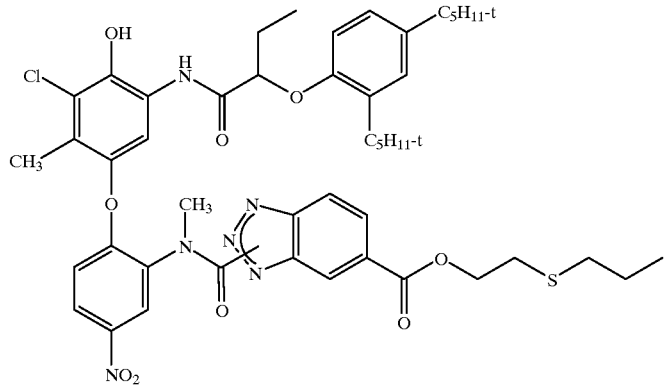

(DC-21)

Compound (8)

Sodium nitrite (0.83 g, 12.0 mmol) was added portionwise to a stirred suspension of (7) (CAS Registry No. 31037-84-0) (4.94 g, 10.0 mmol) in a mixture of acetic acid (50 ml) and propionic acid (10 ml), cooled to 10C. After 30 min the ice bath was removed and the mixture stirred for 3 h. The mixture was added to water (200 ml) stirred for 20 min and the orange/brown residue isolated by decanting, followed by washing with further aliquots of water and decanting. The residue was dissolved in methanol (35 ml) with gentle warming and then allowed to cool. A yellow precipitate was collected by filtration and washed with cold methanol. Yield (2.0 g, 42%)

Compound (9)

A mixture of (8) (14.22 g, 30.0 mmol), 10% Pd-C (3.0 g) and ammonium formate (9.45 g, 150 mmol) in methanol (120 ml) was stirred at room temperature for 1 h. The catalyst was removed by filtration through kieselguhr and the filtrate evaporated. The residue was extracted with dichloromethane (excess ammonium formate non-soluble) and evaporated to dryness. The residue was dissolved in a minimum volume of ethyl acetate and the product precipitated by the addition of excess 60/80 petroleum ether. (Yield 8.92 g, 63%) pale brown solid.

Compound (10)

Sodium hydride 80% (1.2 g, 40 mmol) was added to DMF (50 ml) under a nitrogen atmosphere. The stirred mixture was cooled to 5C (ice bath) and (9) (4.75 g, 10 mmol) was added portionwise over 10 min, the ice bath removed and the mixture stirred for 1 h. The solution was cooled to 5C and a solution of (4) (2.66 g, 10 mmol) in DMF (5 ml) was added all at once. The ice bath was removed and the mixture stirred for 30 min. The mixture was cooled, quenched with isopropanol (5 ml) allowed to warm to room temperature, cooled again and quenched with water (5 ml). The reaction mixture was added to dil. HCl (1 l) stirred and the orange/brown precipitate collected by filtration. The solid was dissolved in ethyl acetate dried over $MgSO_4$ and evaporated to afford a brown solid to give a quantitative yield.

Compound (11)

Phosgene in toluene 20% (20.7 ml, 40 mmol) was added to a solution of (10) (6.25 g, 10 mmol) in toluene (50 ml) and the mixture stirred at room temperature for 1.5 h. The solvent was removed under reduced pressure to afford a brown solid which was used in the next step without further purification.

Coupler (8) (DC-21)

To a solution of (11) (approx 10 mmol) and SI (2.65 g, 10 mmol) in dry dichloromethane (100 ml) was added triethylamine (2.02 g, 20 mmol) and then DMAP (0.21 g, 2.0 mmol) and the mixture stirred for 16 h. The reaction mixture was washed with dilute HCl, the organic layer separated, dried ($MgSO_4$) and evaporated to afford a brown oily residue. Two column chromatography separations (flash silica 20% ethyl acetate: 80% petrol 60/80) provided the required product as a pale yellow glassy solid. Yield (2.14 g, 23% over three steps).

EXAMPLE 4
Preparation of DC-23
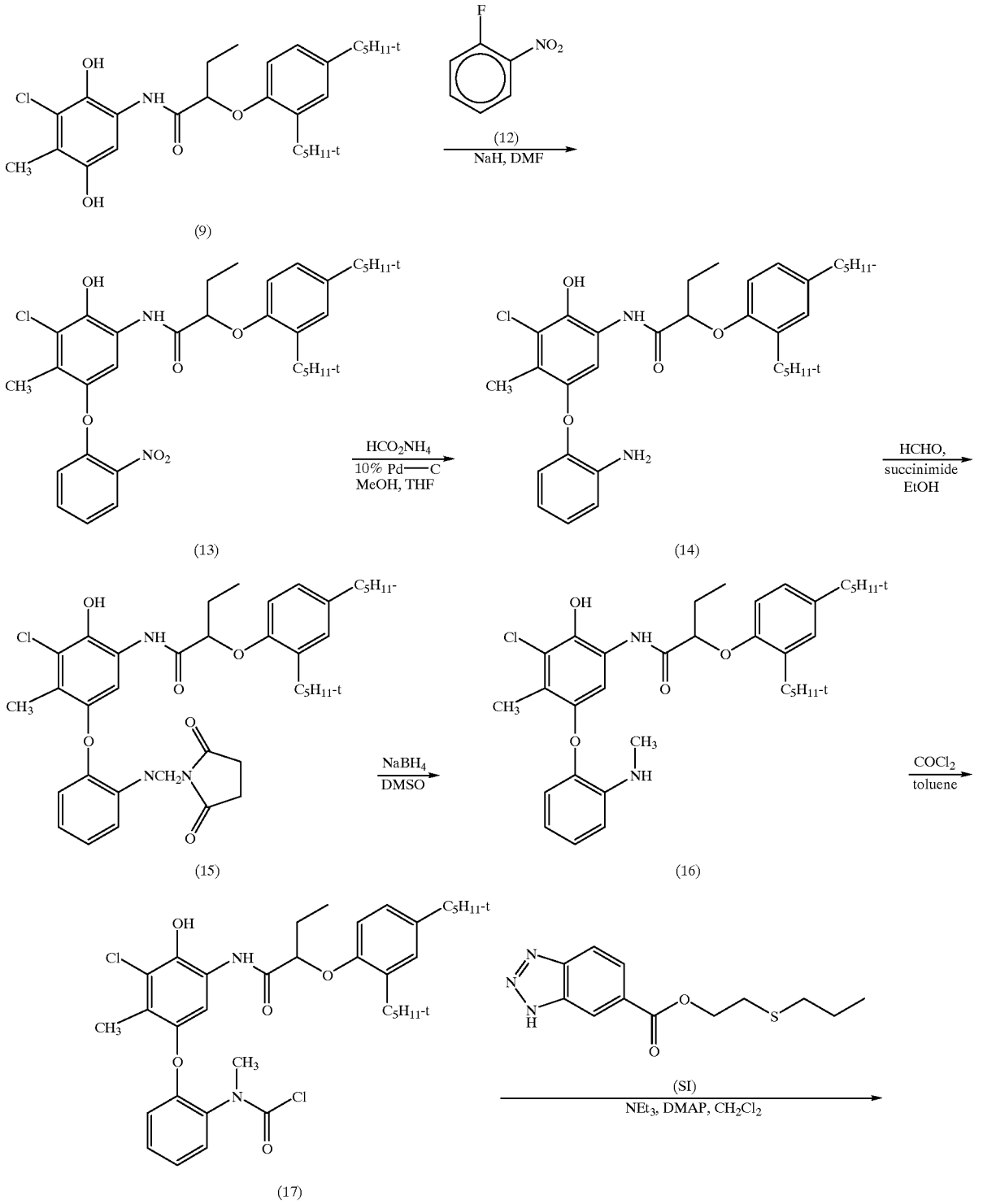

-continued

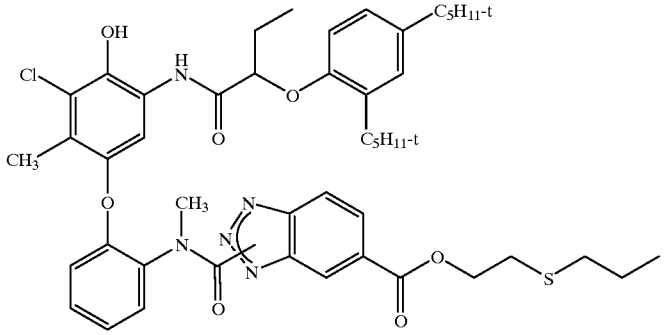

(DC-23)

Compound (13)

Sodium hydride 80% (0.76 g, 25.3 mmol) was added to DMF (100 ml) under a nitrogen atmosphere. The stirred mixture was cooled to 5C (ice bath) and (9) (6.00 g, 12.6 mmol) was added portionwise over 10 min, the ice bath removed and the mixture stirred for 1 h. The solution was cooled to 5C and 2-fluoronitrobenzene (12) (1.78 g, 12.6 mmol) was added all at once. The ice bath was removed and the mixture stirred for 30 min. The mixture was cooled, quenched with isopropanol (5 ml) allowed to warm to room temperature, cooled again and quenched with water (5 ml). The reaction mixture was added to dil. HCl (11), stirred and the orange/brown precipitate collected by filtration. The solid was dissolved in ethyl acetate, dried over $MgSO_4$ and evaporated to afford a brown solid. (7.2 g). Yield 96%.

Compound (14)

A mixture of (13) (7.2 g, 12.1 mmol), ammonium formate (3.82 g, 60.6 mmol) and 10% Pd-C in methanol/THF (1:1, 100 ml ) were stirred at room temperature for 75 min. The catalyst was removed by filtration through kieselguhr and the filtrate evaporated. Dichloromethane (100 ml) was added to the residue and the mixture stirred vigorously for 15 min. The insoluble material (unreacted ammonium formate) was removed by filtration and the filtrate evaporated to afford the required product as a brown solid. (6.0 g)

Compound (15)

Formaldehyde (37%, 2.6 ml, 31.7 mmol) was added to a mixture of (14) (6.0 g, 10.6 mmol) and succinimide (2.1 g, 21.2 mmol) in ethanol (50 ml) and the mixture heated to reflux for 2.5 h. The solvent was evaporated and the residue subject to flash silica chromatography (1:1 ethyl acetate:60/80 petroleum ether). Pure fractions from the chromatography afforded the required product as a yellow/brown glassy solid. Yield 1.87 g (22% over three steps).

Compound (16)

Sodium borohydride (0.31 g, 8.3 mmol) was added in portions (foaming) to a solution of (15) (1.87 g, 2.77 mmol) in dry DMSO (30 ml) and the mixture warmed to 80° C. for 1.5 h. After cooling the mixture was added to 2M HCl (200 ml) and stirred for 0.5 h. The pink/brown solid was collected by filtration and washed with water. The moist solid was dissolved in ethyl acetate, dried over magnesium sulphate and evaporated to afford the required product as a brown glassy solid in a quantitative yield.

Compound (17)

Phosgene in toluene 20% (5.7 ml, 11 mmol) was added to a solution of (16) (2.77 mmol) in toluene (30 ml) and the mixture stirred at room temperature for 1.5 h. The solvent was removed under reduced pressure to afford a viscous brown oil which was used in the next step without further purification.

Coupler (DC-23)

To a solution of (17) (approx. 2.6 mmol) and SI (0.70 g, 2.65mmol) in dry dichloromethane (40 ml) was added triethylamine (0.54 g, 5.3 mmol) and then DMAP (0.06 g, 0.57 mmol) and the mixture stirred for 16 h. The reaction mixture was washed with dilute HCl, the organic layer separated, dried ($MgSO_4$) and evaporated to afford a brown oily residue. Two column chromatography separations (flash silica 20% EtOAc, 80% petrol 60/80) provided the required product as a pale brown glassy solid. Yield (0.90 g, 37% over three steps).

Coupler DC-22 was prepared analogously.

EXAMPLE 5

Preparation of DC-25

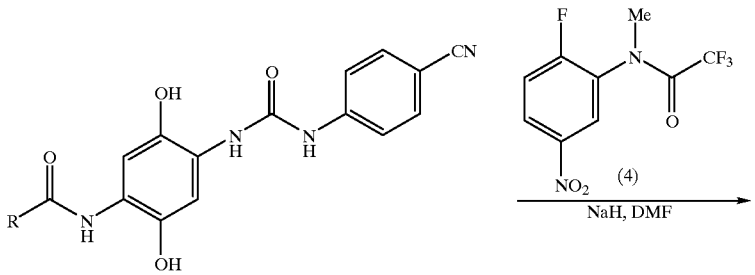

(18)

R = 2,4-di-( t-$C_5H_{11}$)——$C_6H_4$——OCH(n-Bu)——

-continued

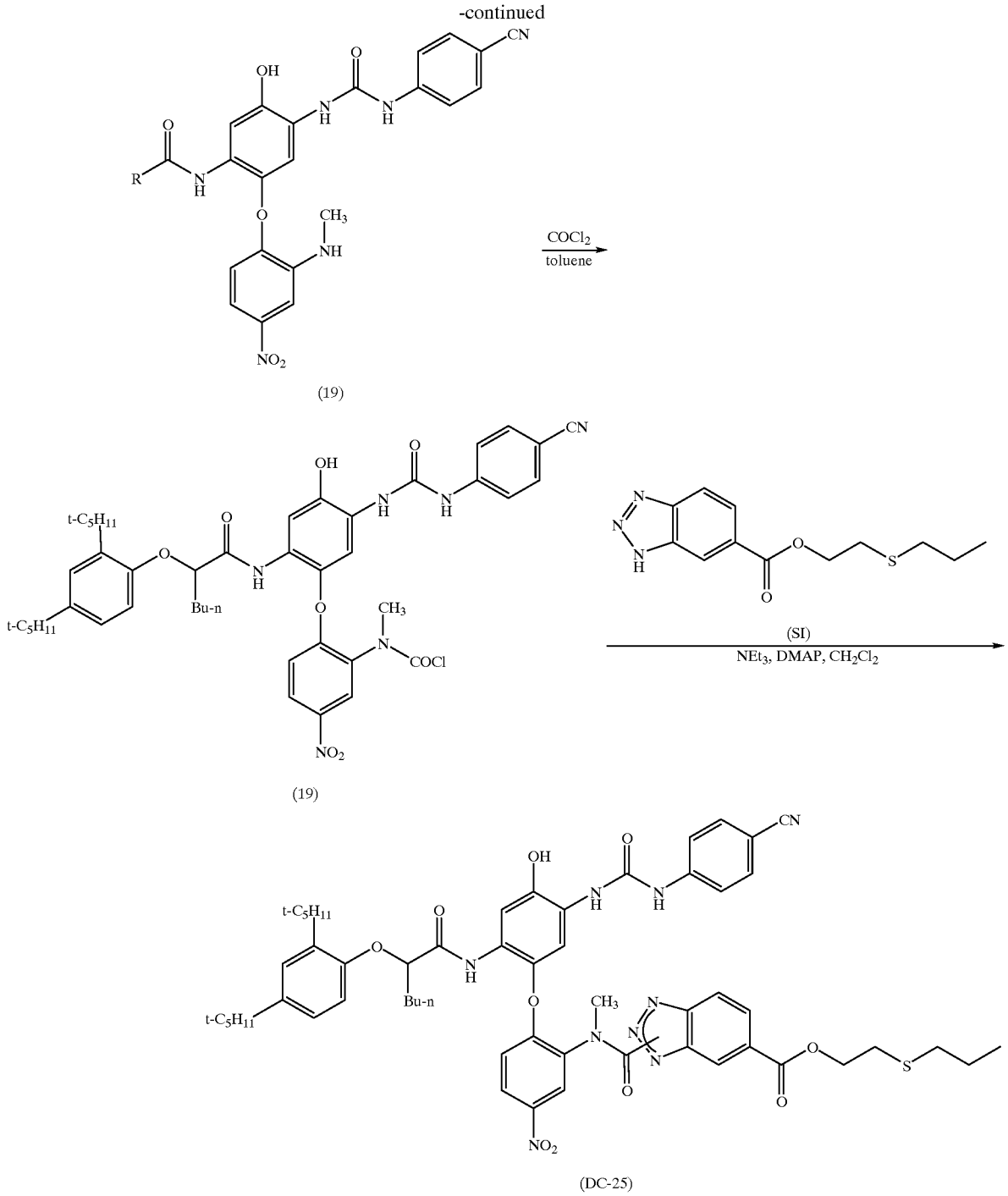

Compound (19)

80% sodium hydride (2.4 g) was added to DMF (75 ml) under a nitrogen atmosphere. The solution was cooled to 6C and compound (18) (CAS Registry No. 94006-34-5) (12.28 g) added portionwise. The icebath was removed and the solution stirred for 1 h. The solution was then cooled to 8C and compound (4) (5.32 g) added. The icebath was removed and the reaction mixture stirred for a further 30 min. The mixture was then cooled to 5C and isopropanol (10 ml) added portionwise and the solution stirred for 1.5 h. Water (10 ml) was then added portionwise at 5C and the solution stirred for 30 min. The solution was then poured into 5% hydrochloric acid solution (1050 ml) and stirred for 30 min. The resultant orange solid was filtered and dried overnight at 40C in vacuo to give a brown solid which was purified by column chromatography (1:2 to 1:1 ethyl acetate:petroleum ether) to give a solid product (4.2 g, 27.%).

Compound (20)

A solution of phosgene in toluene (13 ml) was added to a solution of (19) (4.88 g) in toluene (80 ml) and stirred for 1 h. Acetonitrile (80 ml) was added and the solvent evaporated to give the product (20) as a brown glassy solid (4.98 g).

Coupler DC-25

Compound (20) was dissolved in dichloromethane (80 ml) and compound SI (1.6 g) and triethylamine (1.22 g)

added and the mixture stirred at room temperature for 5 min. DMAP (0.13 g) was added and the reaction mixture was stirred overnight. The reaction mixture was washed with 10% hydrochloric acid, then with water, dried over magnesium sulphate and the solvent removed by evaporation to give the crude product. The product was purified by column chromatography using 3–4% methanol in dichloromethane. The pure product was obtained as a yellow solid (3.5 g, 55%).

EXAMPLE 6

Preparation of DY-4

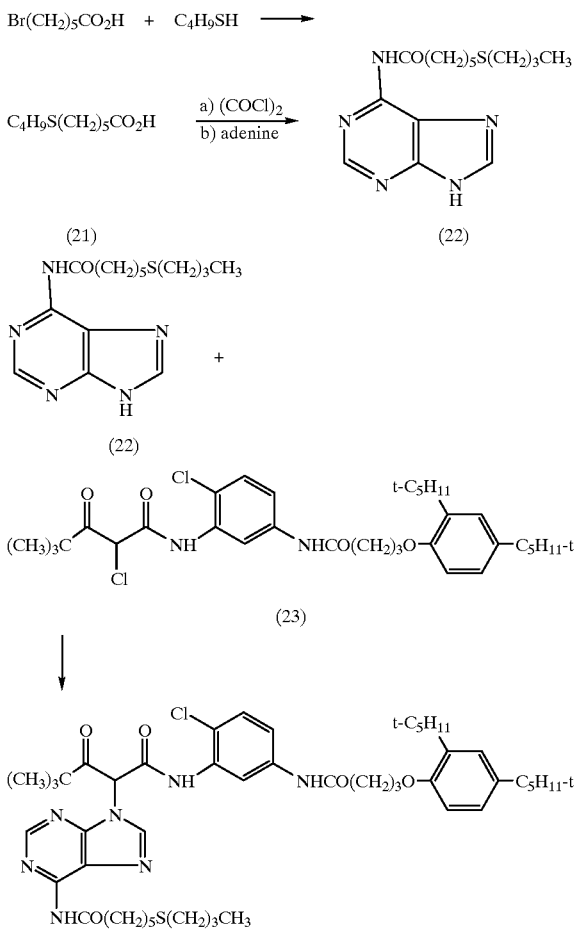

Compound (21)

A solution of 6-bromohexanoic acid (19.51 g, 0,100 mol) in dry THF (200 ml) was added dropwise to a stirred suspension of a 60% dispersion of sodium hydride in oil (8.40 g, 0.210 mol) in dry THF (200 ml) under nitrogen and cooled using an acetone-cardice bath. The temperature of the reaction remained below −10C during the addition. The white suspension was stirred at −10C for 30 min after the addition was complete, then a solution of butanethiol (10.7 ml, 0.100 mol) in dry THF (200 ml) was added dropwise whilst ensuring that the temperature of the reaction remained below −10C. After the addition was complete the thick suspension was heated at reflux for 2 h. The THFx was removed in vacuo and the residual solid dissolved in water (1 l). The aqueous solution was extracted with ether (2×100 ml), then made acidic with concentrated hydrochloric acid (25 ml). The liquid which formed was extracted into ether (3×100 ml). The organic solution was dried (magnesium sulfate) and concentrated in vacuo to give the title compound (19.22 g, 94.2 mmol, 94%) as a straw-coloured liquid.

Compound (22)

Oxalyl chloride (95.0 ml, 57.3 mmol) was added to a stirred solution of (21) (10.51 g, 51.5 mmol) in dichloromethane (100 ml). The solution was heated at reflux for 1 h after which time the gas evolution had ceased. The solvent was removed in vacuo, the residue dissolved in dry pyridine (100 ml) and then adenine (6.95 g, 51.5 mmol) and DMAP (few crystals) were added. The reaction was heated at reflux overnight. The majority of the pyridine was removed in vacuo and the oily residue stirred with saturated sodium hydrogen carbonate solution (500 ml). After 1 h the solid which had formed was removed by filtration and dried at oil-pump vacuum/40C in the presence of phosphorus pentoxide. This gave the title compound (13.42 g, 41.8 mmol, 81%) as a pale brown solid.

Coupler DY-4

A solution of (23) (CAS Registry No. 50771-78-3) (1.89 g, 3.12 mmol), (22) (1.01 g, 3.15 mmol) and triethylamine (0.96 g, 9.50 mmol) in dry DMF (20 ml) was heated at 60C for 3 h. The reaction was added with stirring to a mixture of water (1 l) and concentrated hydrochloric acid (100 ml). The solid which formed was removed by filtration and dissolved in ethyl acetate (200 ml). The organic solution was dried (magnesium sulfate) and concentrated in vacuo to give a dark oil. This was crystallised from a mixture of ethyl acetate and methanol and then recrystallised from ethanol. This gave the title compound (1.30 g, 1.46 mmol, 23%) as a white solid.

PHOTOGRAPHIC EVALUATION

Evaluation of DIRs in a Laydown Series with Image Coupler (a) Evaluation of Cyan DIRs The DIR couplers were evaluated with C-1 as image coupler in single layer photographic coatings containing a 1 μm magenta-sensitised tabular grain silver chloride (0.3% dump iodide) emulsion, on a cellulose acetate based support, according to the following coating diagram:

| | | |
|---|---|---|
| Gel Supercoat | Gelatin | 1.00 g/m$^2$ |
| | Silver chloride | 0.55 g/m$^2$ |
| | Image Coupler | 0.90 mmol/m$^2$ |
| | DIR coupler | 0.108 mmol/m$^2$ |
| Emulsion Layer | Gelatin | 2.42 g/m$^2$ |
| | Bis(vinylsulphonyl)methane | 0.06 g/m$^2$ |
| | (hardener) | 0.06 |
| Support | Cellulose Acetate Support (with Gel U-coat and Removable Carbon Antihalation Backing) | |

The couplers were incorporated in the form of washed dispersions prepared by methods known in the art.

The cyan image coupler (C-1) dispersions contained 7% by weight of gelatin, 7% by weight of coupler and a 1.0:1.0:2.0 weight ratio of coupler to di-n-butyl phthalate coupler solvent to 2-(2-butoxyethoxy)ethyl acetate auxiliary solvent.

The cyan DIR coupler dispersions contained 6% by weight of gelatin, 1% by weight of coupler and a 1.0:2.0:3.0 weight ratio of coupler to di-n-butyl lauramide coupler solvent to cyclohexanone auxiliary solvent.

The yellow DIR control dispersion contained 6% by weight of gelatin, 1% by weight of coupler and a 1.0:2.0:3.0 weight ratio of coupler to di-n-butyl phthalate to cyclohexanone auxiliary solvent.

In each case the auxiliary solvent was included to aid in dispersion preparation and was removed by washing the dispersion for 6 h at 4C and pH 6.0.

(b) Evaluation of DIRs with a cyan image dye-forming coupler—alternative format

The DIR couplers were evaluated with C-4 as image coupler in single layer photographic coatings containing a 1 μm magenta-sensitised tabular grain silver chloride (0.3% dump iodide) emulsion, on a cellulose acetate based support, according to the following coating diagram:

| | | |
|---|---|---|
| Gel Supercoat | Gelatin | 1.08 $g/m^2$ |
| | Silver chloride | 0.70 $g/m^2$ |
| | Image Coupler | 0.90 $mmol/m^2$ |
| | DIR coupler | 0.066 $mmol/m^2$ |
| Emulsion Layer | Gelatin | 1.78 $g/m^2$ |
| | Bis(vinylsulphonyl)methane (hardener) | 0.06 $g/m^2$ |
| Support | Cellulose Acetate Support (with Gel U-coat and grey silver antihalation layer) | |

The couplers were incorporated in the form of washed dispersions prepared by methods known in the art, as previously.

(c) Evaluation of Yellow DIRs

The DIR couplers were evaluated with Y-1 as image coupler in single layer photographic coatings containing a 1 μm magenta-sensitised tabular grain silver chloride (0.3% dump iodide) emulsion, on a cellulose acetate based support, according to the following coating diagram:

| | | |
|---|---|---|
| Gel Supercoat | Gelatin | 1.00 $g/m^2$ |
| | Silver chloride | 0.55 $g/m^2$ |
| | Image coupler | 1.80 $mmol/m^2$ |
| | DIR coupler | 0.108 $mmol/m^2$ |
| Emulsion Layer | Gelatin | 2.42 $g/m^2$ |
| | Bis(vinylsulphonyl)methane (hardener) | 0.06 $g/m^2$ |
| Support | Cellulose Acetate Support (With Gel U-coat and Removable Carbon Antihalation Backing) | |

Aqueous dispersions of the couplers were prepared by methods known in the art.

The yellow image coupler dispersions contained 6% by weight of gelatin, 9% by weight of coupler and a 1.0:0.5:1.5 weight ratio of coupler to di-n-butyl phthalate coupler solvent to cyclohexanone auxiliary solvent.

The yellow DIR coupler dispersions contained 6% by weight of gelatin, 1% by weight of coupler and a 1.0:1.0:2.0 weight ratio of coupler to di-n-butyl phthalate coupler solvent to cyclohexanone auxiliary solvent.

The yellow DIR control dispersion contained 6% by weight of gelatin, 1% by weight of coupler and a 1.0:2.0:3.0 weight ratio of coupler to di-n-butyl phtlhalate to cyclohexanone auxiliary solvent.

In each case the auxiliary solvent was included to aid in dispersion preparation and was removed by washing the dispersion for 6 h at 4C and pH 6.0.

(i) Sensitometric Testing

The experimental photographic coatings prepared in the way described above were slit and chopped into 30 cm×35 mm test strips. After hardening the strips were exposed (0.1 sec) through a 0–4.0 neutral density step wedge (0.2 ND step increments) and Daylight V and Wratten 9 filters then processed through a standard C-41 process as described in the British Journal of Photography Annual (1988) 196–198 using the following steps and process times:

| | |
|---|---|
| Developer | 90 s |
| Stopbath | 1.0 min |
| Wash | 2.0 min |
| Bleach | 4.0 min |
| Wash | 2.0 min |
| Fix | 4.0 min |
| Wash | 2.0 min |

(N.B. The stop-bath was prepared by adding glacial acetic acid to deionised water until pH 3.0 was achieved.)

For each test strip, after removal of the carbon antihalation backing, Status M densities were measured as a function of exposure using a spectral array automatic transmission densitometer (SPADE). Measurements of sensitometric parameters—minimum density ($D_{min}$), maximum density ($D_{max}$), contrast (γ) and photographic speed (KIT)—were obtained from plots of density vs. log exposure (DlogE curves) for each development time.

(ii) Measurement of Relative Gamma and Relative Latitude.

The useful latitude of each sample was quantified by determining the exposure required to enable a Status M density 0.10 above $D_{min}$ and the exposure required to enable a Status M density 0.10 below $D_{max}$ for each sample. The larger the difference in exposure, the greater the useful latitude of the sample. The photographic contrast or gamma (γ) of each sample was quantified as the rate of change of the Status M density obtained after processing as a function of log exposure, at exposure values towards the centre of the sample's useful latitude. Relative gamma could then be calculated as the gamma for processed elements of the invention containing a DIR compound normalised to the gamma for the corresponding reference sample prepared without a DIR and expressed as a percentage (i.e. relative gamma of the reference sample=100). Similarly relative latitude is the latitude obtained for processed elements of the invention containing a DIR compound normalised to the latitude for the corresponding reference sample prepared without a DIR compound and expressed as a percentage (i.e. the relative latitude of the reference sample=100).

(iii) In-film Measurement of Relative Reactivity of the DIR

Experimental coatings were also exposed (0.01 sec) through a 0–1.80 neutral density stepwedge (0.3ND increments) and Daylight V and Wratten filters and processed through a C-41 process (90 s development time) using the same processing sequence as described above. The resultant processed strips were submitted for determination of unreacted coupler and unreacted DIR coupler in each step by HPLC analysis. Using the results of this HPLC analysis $k_{rel}$, a measure of relative reactivity of the DIR, could be determined by plotting the logarithm of the remaining amount of DIR/unit area vs. the logarithm of the remaining amount of image coupler/unit area, obtained for each step of the stepwedge. This gave a linear plot, the gradient or slope of this line being equal to $k_{rel}$.

TABLE 1

Relative Reactivity, Relative Gamma, Relative Latitude and Speed Data for examples of the invention and the controls

| DIR Coupler | Image Coupler | Relative Reactivity (krel) | Relative Gamma | Relative Latitude | Speed | Invention/ control |
|---|---|---|---|---|---|---|
| DY-6 | C-1 | 1.82 | 60.5 | 382 | 256 | control |
| DC-27 | C-1 | 5.7 | 67.7 | 424 | 246 | control |
| DC-7 | C-1 | 0.15 | 42.3 | 802 | 279 | invention |
| DC-21 | C-1 | 0.66 | 61.1 | 587 | 286 | invention |
| DC-22 | C-1 | 0.45 | 56.8 | 626 | 285 | invention |
| DC-23 | C-1 | 0.33 | 56.2 | 630 | 287 | invention |
| DC-25 | C-1 | 0.38 | 58.6 | 562 | 283 | invention |
| DC-6 | C-1 | 0.80 | 47.1 | 763 | 273 | invention |
| DU-3* | C-4 | 1.5 | 54.3 | 387 | 251 | control |
| DY-3* | C-4 | 0.35 | 41.7 | 654 | 264 | invention |
| DM-6* | C-4 | 0.9 | 42.3 | 633 | 260 | invention |
| DY-6** | Y-1 | 1.99 | 62.4 | 242 | 277 | control |
| DY-4** | Y-1 | 0.32 | 53.1 | 414 | 280 | invention |
| DY-5** | Y-1 | 0.63 | 57.5 | 316 | 282 | invention |

wherein Speed is a threshold measurement which is independent of contrast.

In the Table 1, the laydown of DIR in each combination is 12% with the exception of those marked * wherein the laydown of DIR is 7.3% and those marked ** wherein the laydown of DIR is 6%.

From Table 1 it can be seen that the inventive combinations provide greater relative latitude and lower relative gamma than the control combinations. This improvement in photographic performance is achieved with less speed loss than shown by the control combinations.

TABLE 2

$K_{rel}$ data for DIR/C-1 image coupler combinations

| Inventive | | Control | |
|---|---|---|---|
| DIR | $K_{rel}$ | DIR | $K_{rel}$ |
| DC-8 | 0.17 | DC-26 | 6.50 |
| DC-9 | 0.13 | DC-27 | 5.70 |
| DC-10 | 0.92 | DC-28 | 1.61 |
| | | DC-29 | 1.36 |
| | | DC-30 | 4.10 |
| | | DY-6 | 1.82 |

TABLE 3

$K_{rel}$ data for other DIR/image coupler combinations

| | | | |
|---|---|---|---|
| DC-1/C-5 | 0.43 | DM-1/M-3 | 0.40 |
| DC-2/C-5 | 1.00 | DM-2/M-3 | 0.60 |
| DC-3/M-1 | 0.55 | DM-3/M-3 | 0.40 |

TABLE 4

Other DIR/image coupler combinations with $k_{rel}$ <1

| | |
|---|---|
| DC-4/C-2 | DU-1/Y-3 |
| DC-5/C-3 | DU-2/Y-4 |
| DY-2/Y-1 | DM-5/M-1 |
| DY-1/Y-2 | DM-4/M-2 |

Tables 2 to 4 show that by manipulating the structures of the DIR and image couplers a range of $k_{rel}$ values for combinations can be obtained showing that judicious selection of substituents will give a $k_{rel}$ value for a DIR/image coupler combination of less than or equal to 1.0.

Figure 2:
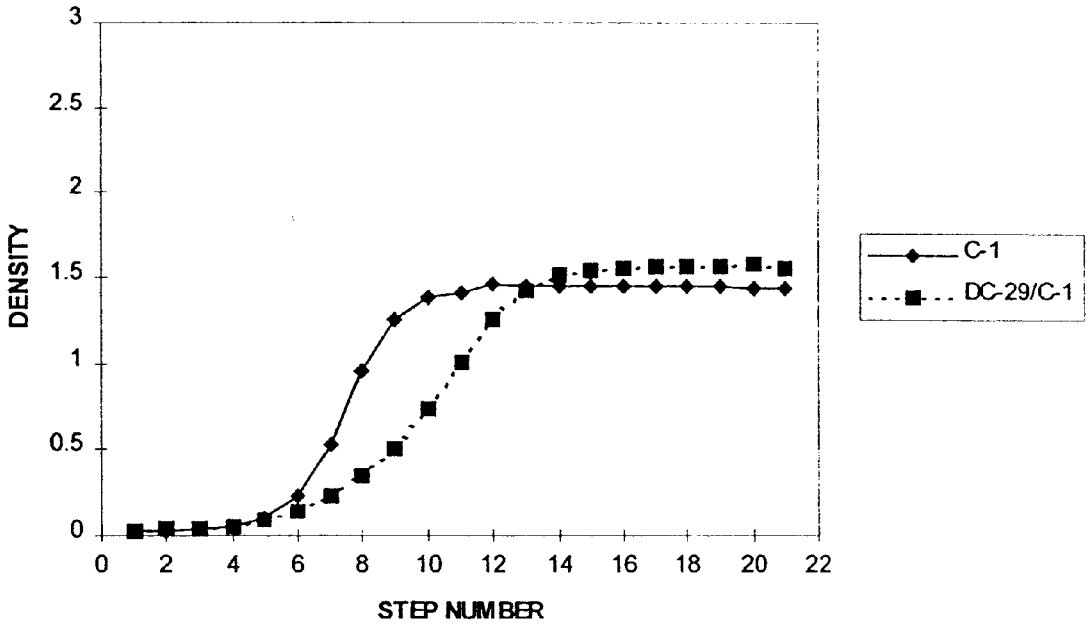
Figure 3:
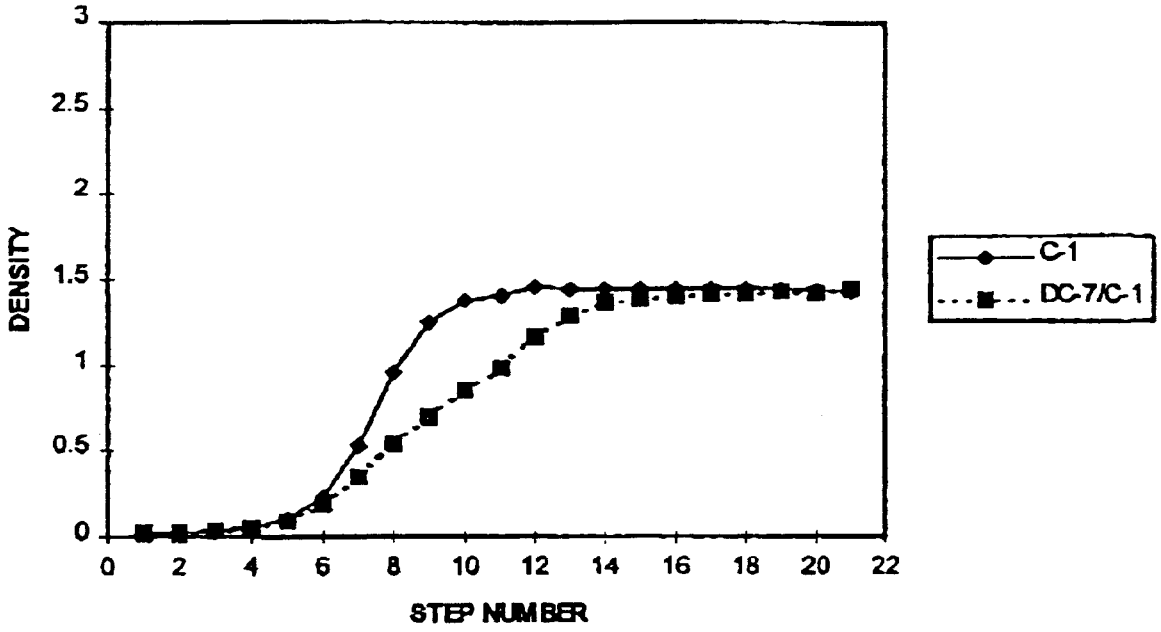
FIG. 3 shows a similar plot of image coupler C-1 alone and for the inventive combination of DIR coupler DC-7 in association with image coupler C-1, at a molar ratio of 12:100.

FIGS. 1 to 3:

FIG. 3 shows that the inventive combination of DIR coupler DC-7 with the image coupler C-1 ($k_{rel}$=0.15) produces a Density vs. Step Number or exposure (DlogE) curve shape of large relative latitude and lower contrast relative to that of the image coupler C-1 alone, with minimal loss in speed. However control DIR/image coupler combinations of high relative reactivity ($k_{rel}$>1.0), such as DY-6 in combination with C-1 in FIG. 1 or DC-29 in combination with C-1 in FIG. 2, provide inferior curve shape control, resulting in DlogE curves with smaller relative latitude, higher contrast and more "toe-scooping" or loss in speed than the inventive combination.

What is claimed is:

1. A photographic element comprising at least one emulsion layer comprising at least 50 mol % silver chloride, which layer comprises at least one DIR coupler in association with at least one cyan or magenta image dye-forming coupler, wherein the relative reactivity ratio $k_{rel}$ of at least one DIR coupler and an associated image coupler is less than or equal to 1.0, wherein $$k_{rel}=k_1/k_2;$$

$k_1$=the second order rate constant for the reaction of DIR coupler with oxidised developer and $k_2$=the second order rate constant for the reaction of image coupler with oxidised developer.

2. An element as claimed in claim 1 wherein the reactivity ratio is less than 0.7.

3. An element as claimed in claim 1 wherein the reactivity ratio is less than 0.3.

4. An element as claimed in claim 1 wherein the emulsion layer contains at least 90 mol % silver chloride.

5. An element as claimed in claim 1 wherein at least 30% of the silver chloride grains have T-grain morphology.

6. An element as claimed in claim 1 wherein the inhibitor in the DIR coupler is the S-assist benzotniazole moiety SI

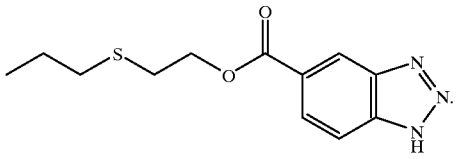

7. An element as claimed in claim 1 wherein the DIR is a development inhibitor anchiomeric-releasing (DIAR) coupler.

8. An element according to claim 7 wherein the DIAR coupler contains a switch group selected from a carbamate switch, a quinone-methide switch or an aminoacid switch group linked to a quinone methide switch.

9. An element as claimed in claim 1 wherein the ratio of the amount of DIR coupler to its associated image coupler is from about 5 to about 20%.

10. A multicolour photographic element comprising a support beauing a cyan image-dye-forming unit comprising at least one red-sensitive silver halide emulsion layer and a cyan dye-forming coupler, a magenta image-dye-forming unit comprising at least one green-sensitive silver halide emulsion layer and a magenta dye-forming coupler; a yellow image-dye-forming unit comprising at least one blue-sensitive silver halide layer and a yellow dye-forming coupler, wherein at least one of the layers comprises an emulsion comprising at least 50 mol % silver chloride, which layer comprises at least one DIR coupler in association with at least one image dye-forming coupler, wherein in any one layer the relative reactivity ratio $k_{rel}$ of at least one DIR coupler and an associated image coupler is less than or equal to 1.0, wherein $$k_{rel}=k_1/k_2;$$

$k_1$=the second order rate constant for the reaction of DIR coupler with oxidised developer and $k_2$=the second order rate constant for the reaction of image coupler with oxidised developer.

11. A multicolour photographic element as claimed in claim 10 wherein the DIR coupler is the S-assist benzotniazole moiety SI

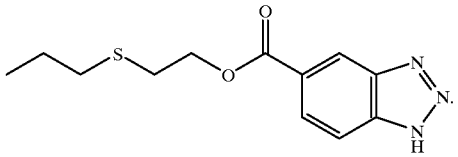

12. A multicolour photographic element as claimed in claim 10 wherein the DIR is a development inhibitor anchiomeuic-releasing (DIAR) coupler.

13. A multicolour photographic element as claimed in claim 11 wherein the DIAR coupler contains a switch group selected from a carbamate switch, a quinone-methide switch or a aminoacid switch group linked to a quinone methide switch.

14. A process of forming an image in a photographic element after the element has been imagewise exposed to light, comprising contacting the element with a colour developing agent, wherein the element comprising at least one emulsion layer comprising at least 50 mol % silver chloride, which layer comprises at least one DIR coupler in association with at least one image dye-forming coupler, wherein the relative reactivity ratio $k_{rel}$ of at least one DIR coupler and an associated image coupler is less than or equal to 1.0, wherein $$k_{rel}=k_1/k_2;$$

$k_1$=the second order rate constant for the reaction of DIR coupler with oxidised developer and $k_2$=the second order rate constant for the reaction of image coupler with oxidised developer.

* * * * *

UNITED STATES PATENT AND TRADEMARK OFFICE

CERTIFICATE OF CORRECTION

PATENT NO. : 6,346,371 B1
DATED : February 12, 2002
INVENTOR(S) : Andrew S. Craig et al.

It is certified that error appears in the above-identified patent and that said Letters Patent is hereby corrected as shown below:

Title page,
Item [22], delete "Dec. 10, 1999" and insert -- Dec. 20, 1999 --.

Signed and Sealed this

Twentieth Day of August, 2002

*Attest:*

*Attesting Officer*

JAMES E. ROGAN
*Director of the United States Patent and Trademark Office*